US010182688B2

(12) United States Patent
Goldsmith

(10) Patent No.: US 10,182,688 B2
(45) Date of Patent: Jan. 22, 2019

(54) SPLASH-REDUCING AND VELOCITY-INCREASING CARTRIDGE EXIT

(71) Applicant: Falcon Waterfree Technologies, LLC, Los Angeles, CA (US)

(72) Inventor: Edward Michael Goldsmith, Encino, CA (US)

(73) Assignee: FALCON WATERFREE TECHNOLOGIES, LLC, Los Angeles, CA (US)

( * ) Notice: Subject to any disclaimer, the term of this patent is extended or adjusted under 35 U.S.C. 154(b) by 402 days.

(21) Appl. No.: 14/288,956

(22) Filed: May 28, 2014

(65) Prior Publication Data

US 2014/0352044 A1 Dec. 4, 2014

Related U.S. Application Data

(60) Provisional application No. 61/928,999, filed on Jan. 17, 2014, provisional application No. 61/828,153,
(Continued)

(51) Int. Cl.
*A47K 11/12* (2006.01)
*E03D 13/00* (2006.01)

(52) U.S. Cl.
CPC ..... *A47K 11/12* (2013.01); *E03D 13/005* (2013.01); *E03D 13/007* (2013.01)

(58) Field of Classification Search
CPC ..... E03D 13/005; E03D 13/007
(Continued)

(56) References Cited

U.S. PATENT DOCUMENTS 1,745,010 A 1/1930 Lamprecht
2,675,823 A 4/1954 Langdon
(Continued)

FOREIGN PATENT DOCUMENTS

AU 8303367 9/2006
AU 8303368 9/2008
(Continued)

OTHER PUBLICATIONS

International Search Report and the Written Opinion of the International Searching Authority for PCT/US2014/039765; dated Sep. 24, 2014.

(Continued)

*Primary Examiner* — Christine Skubinna
(74) *Attorney, Agent, or Firm* — Tope-McKay & Associates

(57) ABSTRACT

A fluid exit portion for a splash-reducing urinal cartridge is presented. The exit portion comprises a splash reducer for causing fluid to exit the cartridge in a splash-reduced manner. The splash reducer is generally in the form of a spout with a tapered exit area for accelerating and directing the fluid. The spout may comprise converting fins to urge fluid to collect in a progressively narrower channel. When the cartridge is installed into a housing, the splash reducer ensures that fluid exiting the cartridge transitions into the housing with minimal disturbance, substantially parallel to the housing. The splash reducer is formed of a flexible material or is hinged with respect to the cartridge body to allow for easy insertion into a housing.

17 Claims, 22 Drawing Sheets

Related U.S. Application Data filed on May 28, 2013, provisional application No. 61/828,165, filed on May 28, 2013, provisional application No. 61/828,169, filed on May 28, 2013.

(58) Field of Classification Search
USPC ..... 4/144.1
See application file for complete search history.

(56) References Cited

U.S. PATENT DOCUMENTS 3,047,013 A 7/1962 Baumbach
3,967,645 A 7/1976 Gregory
4,086,668 A 5/1978 Tubbs
4,518,014 A 5/1985 McAlpine
4,574,400 A 3/1986 Annowsky
4,574,403 A 3/1986 Dintemann et al.
4,578,207 A 3/1986 Holdt et al.
4,595,346 A 6/1986 Bozoyan
4,683,071 A 7/1987 Holdt et al.
4,937,892 A 7/1990 Syrenne
5,193,585 A 3/1993 Proffitt et al.
5,581,823 A 12/1996 Kuo
5,604,937 A 2/1997 Davenport
5,606,995 A 3/1997 Raftis
5,711,037 A 1/1998 Reichardt et al.
5,727,593 A 3/1998 Duer
5,813,058 A 9/1998 Quigley et al.
6,009,567 A 1/2000 Dean et al.
6,053,197 A 4/2000 Gorges
6,105,916 A 8/2000 Zlotnik et al.
6,247,189 B1 6/2001 Dean et al.
6,286,153 B1 9/2001 Keller
6,401,266 B1 6/2002 Mitchell et al.
6,425,411 B1 7/2002 Gorges
6,640,356 B1 11/2003 Hans
6,644,339 B2 11/2003 Gorges et al.
6,701,541 B2 3/2004 Romagna et al.
6,750,773 B2 6/2004 Higgins
6,959,723 B2 11/2005 Gorges
6,973,939 B2 12/2005 Georges et al.
6,977,005 B2 12/2005 Erdmann et al.
D544,574 S 6/2007 Cummings
7,243,681 B2 7/2007 Dahm
7,422,034 B2 9/2008 Dahm
7,511,004 B2 3/2009 Cheung et al.
D598,523 S 8/2009 McAlpine
D598,987 S 8/2009 McAlpine
7,571,741 B2 8/2009 Higgins
7,575,022 B2 8/2009 Higgins
7,636,957 B2 12/2009 Funari
7,709,433 B2 5/2010 Veltman et al.
D618,322 S 6/2010 Keller
D620,584 S 7/2010 McAlpine
7,757,312 B2 7/2010 Stack et al.
7,900,288 B2 3/2011 Fima
8,006,324 B2 8/2011 Ophardt et al.
8,007,707 B1 8/2011 Brown et al.
D644,717 S 9/2011 Larkin et al.
8,234,723 B2 8/2012 Allen
8,277,715 B2 10/2012 Arora et al.
8,291,522 B2 10/2012 Kueng
8,444,771 B2 5/2013 Leipold et al.
8,485,216 B2 7/2013 Higgins
8,510,875 B2 8/2013 Helbig et al.
8,590,068 B2 11/2013 Stack et al.
8,646,117 B2 2/2014 Avetisian
2002/0069913 A1 6/2002 Gorges et al.
2002/0116753 A1 8/2002 Mitchell et al.
2002/0120981 A1 9/2002 Gorges
2003/0089397 A1 5/2003 Georges
2004/0010843 A1 1/2004 Erdmann et al.
2004/0134534 A1 7/2004 Gorges et al.
2004/0211267 A1 10/2004 Higgins
2005/0229297 A1 10/2005 Higgins
2005/0229971 A1* 10/2005 Higgins ..... E03C 1/28 137/247.13
2005/0247342 A1 11/2005 Higgins
2006/0064805 A1 3/2006 Yamamoto et al.
2006/0101565 A1 5/2006 Cummings
2006/0118176 A1 6/2006 Ring et al.
2006/0207005 A1 9/2006 Janssen
2006/0225195 A1 10/2006 Scholer
2007/0006370 A1 1/2007 Schroder
2007/0048247 A1 3/2007 Martin et al.
2007/0083989 A1 4/2007 Higgins et al.
2007/0186337 A1 8/2007 Emr
2007/0209979 A1 9/2007 Helbig et al.
2007/0257218 A1 11/2007 Bood et al.
2008/0028504 A1* 2/2008 Higgins ..... E03C 1/281 4/144.1
2008/0093845 A1 4/2008 Higgins
2008/0295233 A1 4/2008 Fima
2008/0256695 A1 10/2008 Allen
2008/0269097 A1 10/2008 Cheung et al.
2008/0303186 A1 12/2008 Lu
2008/0313795 A1 12/2008 Lu
2009/0056003 A1* 3/2009 Ivie ..... A61F 5/4556 4/144.3
2009/0165197 A1 7/2009 Seibt
2009/0235443 A1 9/2009 Arora et al.
2010/0024892 A1 2/2010 Higgins
2010/0095445 A1 4/2010 Rice et al.
2010/0120648 A1 5/2010 Veltman et al.
2010/0186156 A1 7/2010 Ophardt et al.
2010/0192291 A1 8/2010 Burt et al.
2010/0192295 A1 8/2010 Fima
2010/0199412 A1 8/2010 McAlpine
2010/0199415 A1 8/2010 Fima
2010/0205725 A1* 8/2010 McAlpine ..... E03C 1/264 4/144.1
2010/0230333 A1* 9/2010 Avetisian ..... E03C 1/28 210/127
2011/0010833 A1 1/2011 Fima
2011/0016619 A1 1/2011 Keller
2011/0036417 A1 2/2011 McAlpine
2011/0203048 A1 8/2011 Fima
2011/0209276 A1 9/2011 Lu et al.
2011/0219528 A1 9/2011 Cadavid
2011/0223059 A1 9/2011 Lu et al.
2011/0252552 A1 10/2011 Janssen
2011/0296597 A1 12/2011 Brown et al.
2012/0023649 A1 2/2012 Helbig et al.
2012/0066822 A1 3/2012 Kueng
2012/0167295 A1 7/2012 Fima
2012/0167296 A1 7/2012 Nomura et al.
2012/0228800 A1 9/2012 Arora et al.
2012/0317707 A1 12/2012 Romero
2013/0000766 A1 1/2013 McAlpine et al.
2013/0015388 A1 1/2013 Keller
2013/0031708 A1 2/2013 Sensel
2013/0067646 A1* 3/2013 McEwan ..... A47K 11/12 4/144.1
2013/0067651 A1 3/2013 Brown et al.
2013/0104305 A1 5/2013 Stack et al.

FOREIGN PATENT DOCUMENTS

AU 10320652 11/2010
AU 11235550 3/2011
CA 2700702 4/2009
CA 2700704 4/2009
CA 2786562 5/2011
CN 2386089 8/1999
CN 2559699 7/2003
CN 2656515 11/2004
CN 2693831 4/2005
CN 2699813 5/2005
CN 2781131 5/2006
CN 1930347 3/2007
CN 101260686 A 9/2008
CN 201198591 2/2009
CN 201343756 11/2009

(56) References Cited

FOREIGN PATENT DOCUMENTS

| | | | |
|---|---|---|---|
| CN | 101260686 | | 6/2010 |
| CN | 201649272 | | 11/2010 |
| CN | 201843191 | | 5/2011 |
| CN | 201843210 | | 5/2011 |
| CN | 10245223 | | 4/2012 |
| CN | 102482870 | | 5/2012 |
| CN | 202273300 | | 6/2012 |
| CN | 102597382 | | 7/2012 |
| CN | 102635151 | | 8/2012 |
| CN | 202577519 | | 12/2012 |
| DE | 362324 | | 7/1920 |
| EP | 0 916 774 | A2 | 11/1996 |
| EP | 0 916 774 | A3 | 11/1996 |
| EP | 1 174 549 | | 1/2002 |
| EP | 1 174 549 | A2 | 1/2002 |
| EP | 1 174 549 | A3 | 1/2002 |
| EP | 1 785 077 | | 5/2007 |
| EP | 2 472 014 | | 6/2013 |
| GB | 0422136 | | 7/1933 |
| GB | 0468282 | | 12/1935 |
| GB | 0620277 | | 8/1938 |
| GB | 0718597 | | 3/1951 |
| GB | 0725125 | | 11/1953 |
| GB | 1103425 | | 5/1954 |
| GB | 0915103 | | 7/1961 |
| GB | 1006930 | | 10/1961 |
| GB | 1006945 | | 4/1962 |
| GB | 1103426 | | 5/1965 |
| GB | 1203608 | | 12/1967 |
| GB | 2 153 048 | | 8/1985 |
| GB | 153 048 | | 8/1985 |
| GB | 2 190 466 | | 11/1987 |
| GB | 2 296 309 | | 6/1996 |
| GB | 2 320 310 | | 6/1998 |
| GB | 2 346 198 | | 2/2000 |
| GB | 2 346 198 | | 12/2002 |
| GB | 2449364 | | 11/2008 |
| GB | 2467669 | A | 8/2010 |
| GB | 2469585 | A | 10/2010 |
| GB | 2 470 839 | A | 12/2010 |
| GB | 2473055 | | 3/2011 |
| GB | 2488664 | | 9/2012 |
| GB | 2 470 839 | B | 1/2013 |
| GB | 2467669 | B | 2/2013 |
| GB | 2469585 | B | 2/2013 |
| JP | 49 5434 | | 4/1972 |
| JP | 63166772 | | 7/1988 |
| JP | 1993090063 | | 4/1993 |
| JP | 04905434 | | 1/2012 |
| JP | 05090063 | | 12/2012 |
| KR | 877603 | | 1/2009 |
| KR | 2010013602 | | 2/2010 |
| KR | 2010076858 | | 7/2010 |
| NZ | 0543551 | | 11/2005 |
| NZ | 0586547 | | 6/2010 |
| RU | 2010130666 | A | 12/2008 |
| WO | WO 99/07953 | | 2/1999 |
| WO | WO 99/57382 | | 11/1999 |
| WO | WO 01/46075 | | 6/2001 |
| WO | WO 2004059198 | | 7/2004 |
| WO | WO 2004/090245 | | 10/2004 |
| WO | WO 2004/100742 | | 11/2004 |
| WO | WO 2005071173 | | 8/2005 |
| WO | WO 2007149379 | | 12/2007 |
| WO | WO 2009/026733 | | 3/2009 |
| WO | WO 2009/040524 | | 4/2009 |
| WO | WO 2009/040525 | | 4/2009 |
| WO | WO 2009/081155 | | 7/2009 |
| WO | WO 2009/081156 | | 7/2009 |
| WO | WO 2009/144479 | | 12/2009 |
| WO | WO 2010/074411 | | 1/2010 |
| WO | WO 2010/067049 | | 6/2010 |
| WO | WO 2010074411 | | 7/2010 |
| WO | WO 2010/091862 | | 8/2010 |
| WO | WO 2011/012860 | | 2/2011 |
| WO | WO 2011/061515 | | 5/2011 |
| WO | WO 2011/094880 | | 8/2011 |
| WO | WO 2011/120177 | | 10/2011 |
| WO | WO 2011/120178 | | 10/2011 |
| WO | WO 2011/120179 | | 10/2011 |
| WO | WO 2012/117221 | | 9/2012 |
| WO | WO 2013/017373 | | 2/2013 |
| WO | WO 2013/017424 | | 2/2013 |
| ZA | 198303028 | A | 4/1983 |

OTHER PUBLICATIONS

Supplementary European Search Report for European patent application No. 14804255.9; dated Nov. 2, 2017.

Notification Concerning Transmittal of International Preliminary Report on Patentability for PCT/US2014/039765; dated Dec. 10, 2015.

International Preliminary Report on Patentability for PCT/US2014/039765; dated Dec. 10, 2015.

English translation for Office Action 1 for Chinese patent application No. 201480031014.8; dated Aug. 16, 2016.

Response to Office Action 1 for Chinese patent application No. 201480031014.8; dated Dec. 30, 2016.

English translation for Office Action 2 for Chinese patent application No. 201480031014.8; dated May 11, 2017.

Response to Office Action 2 for Chinese patent application No. 201480031014.8; dated Jul. 14, 2017.

English translation for Office Action 3 for Chinese patent application No. 201480031014.8; dated Nov. 28, 2017.

Response to Office Action 3 for Chinese patent application No. 201480031014.8; dated Feb. 1, 2018.

Amended Claims for Response to Office Action 3 for Chinese patent application No. 201480031014.8; dated Feb. 1, 2018.

English translation for Office Action 1 for Colombian patent application No. 15300236; dated Feb. 25, 2016.

Response to Office Action 1 for Colombian patent application No. 15300236; dated Jun. 29, 2017.

Office Action 2 for Colombian patent application No. 15300236; dated Jun. 16, 2016.

Response to Office Action 2 for Colombian patent application No. 15300236; dated Sep. 12, 2017.

Amended Claims for Response to Office Action 2 for Colombian patent application No. 15300236; dated Sep. 12, 2017.

Notice of Allowance for Colombian patent application No. 15300236; dated Dec. 7, 2017.

English translation for Office Action 1 for Taiwan patent application No. 103118618; dated Jun. 7, 2017.

Search Report for Taiwan patent application No. 103118618; dated Jun. 7, 2017.

Response to Office Action 1 for Taiwan patent application No. 103118618; dated Aug. 31, 2017.

English translation for Office Action 2 for Taiwan patent application No. 103118618; dated Nov. 13, 2017.

Response to Office Action 2 for Taiwan patent application No. 103118618; dated Jan. 30, 2018.

* cited by examiner

SPLASH-REDUCING AND VELOCITY-INCREASING CARTRIDGE EXIT

CROSS-REFERENCE TO RELATED APPLICATIONS

This application claims the benefit of U.S. Provisional Application No. 61/828,153, filed May 28, 2013, titled "Tapered High Velocity Exit with Flexible Tip," U.S. Provisional Application No. 61/928,999, filed Jan. 17, 2014, titled "Tapered High Velocity Exit with Flexible Tip." and U.S. Provisional Application No. 61/828,169, filed May 28, 2013, titled "Wrap Around Baffle with Vented Cone Shaped Top," and U.S. Provisional Application No. 61/828,165, filed May 28, 2013, titled "Hybrid Trap With Water Injection Cleaning."

BACKGROUND OF THE INVENTION (1) Field of the Invention

The present invention relates to a waterless urinals and more particularly, to waterless urinal cartridges that include a mechanism to reduce the splashing of fluids exiting the cartridge into a housing or other connected plumbing elements in order to reduce precipitant buildup and to assist in cleaning.

(2) Description of Related Art

Water is a scarce and diminishing resource in many areas of the world. It is widely recognized that more must be done to conserve its usage as populations grow and climates change. Water conserving products are becoming increasingly important not only for quality of human life but also for sanitary and subsistence reasons.

There have been many water conserving measures taken across the world in an effort to deal with limited and diminishing resources. Many municipalities have come up with rationing plans. Others have invested in waste-water recycling treatment and re-use.

There have also been many water conserving products introduced to the market place. These products are becoming more widely used by the industry and home owners as regulations and the rising cost of water usage drive the need for change. Non-flushing urinal designs use far less water than traditional urinals, saving up to 40,000 gallons of water a year from a single urinal. Non-flushing urinals generally comprise three major components: a porcelain urinal, a housing, and a cartridge. The porcelain urinal component is very similar to that of a traditional urinal. The housing replaces a traditional P-trap which normally would connect a urinal to a building's plumbing. Thus, the housing sits in-line between the building's plumbing and the bottom of the urinal where the drain pipe would normally connect. The cartridge fits in the housing and can be removed for servicing and replacement.

There are two types of cartridges for non-flushing urinals: liquid trap style cartridges and mechanical trap style cartridges. The liquid trap style cartridge serves two purposes. First, it acts as a barrier from sewer gasses and odors coming into the restroom. Second, it acts as a filer removing some of the solids that precipitate from human urine (urine is a super saturated liquid). Human urine is an aqueous solution of greater than 95% water, with the remaining constituents, in order of decreasing concentration, urea 9.3 g/L, chloride 1.87 g/L, sodium 1.17 g/L, potassium 0.750 g/L creatinine 0.670 g/L and other dissolved ions, inorganic and organic compounds, according to the NASA Contractor Report No. NASA CR-1802, D. F. Putnam, July 1971. The liquid trap style cartridge works by using two mechanisms. First, urine fills the P-trap of the cartridge forming a barrier against the sewer gasses—just as water does in a traditional P-trapped urinal. Second, a layer of low density fluid, such as oil, is placed in the trap so that it floats on top of the urine. This floating oil forms a barrier keeping unpleasant urine smells from entering the bathroom. As a user urinates into the urinal, fresh urine enters the cartridge, sinks through the floating oil barrier, and presses old urine out of the trap and out through the housing exit tube and into the building's plumbing.

The mechanical trap style non-flushing urinals work in a slightly different manner. All components are similar to the above mentioned liquid trap style of non-flushing urinal except for the cartridge. In this case, the liquid sealant is replaced with some form of a valve that allows urine to go through, while blocking gas and odor from escaping back through the system and into the restroom. An example of this trap is one made by Liquidbreaker and subject of U.S. Pat. No. 7,900,288. In this model two silicone valves are used that rest on plastic seats. When urine flows down on top of the silicon valve at the center of the cartridge, the valve is opened by the weight of the urine. When the urine drips off the valve and into the housing, the valve closes sealing out gasses.

Although there are some significant water-saving benefits from using non-flushing urinals, there are also some drawbacks. One of the most significant is the formation of Struvite in the pipes, housing, and on the mechanical valve components of the mechanical type cartridge. Struvite (magnesium ammonium phosphate) is a phosphate mineral with formula: NH4MgPO4.6H2O. Struvite crystallizes in the orthorhombic system as white to yellowish or brownish-white pyramidal crystals or in platey mica-like forms. It is a soft mineral with Mohs hardness of 1.5 to 2 and has a low specific gravity of 1.7. It is sparingly soluble in neutral and alkaline conditions, but readily soluble in acid.

While flushing urinals also produce buildup in the pipes, it is found to be more of a hard calcified nature. With non-flushing urinals, it has been found that struvite formation is more common; particularly in areas of slow velocity flows or high splash. The struvite builds up mostly in the leg from the urinal to the building's down pipes in both the mechanical and the liquid trap non-flushing systems unless they are regularly flushed out with water—the building's down pipes receive water from other sources in the building and are thus often rinsed. Struvite also tends to build up in the bottom of the urinal housing, leaving a very unpleasant odor and appearance. This makes changing the cartridge an unpleasant chore for maintenance staff members. When pipes are clogged, they must be snaked out. This can be a difficult and unpleasant process as well.

Struvite also builds up in areas prone to splashing; for example the area underneath the exit of the cartridge. The splashing of urine causes solids to precipitate out of the urine and significant buildup can occur. Additionally, as noted above, struvite tends to build up where urine flow is slow or still. Prior art non-flushing urinal and trap designs suffer from splashing and/or slow flow and as a result, they tend to build up struvite deposits quickly. Increasing velocity of the flow, while minimizing the splash that occurs as the urine transfers from the cartridge or trap to the housing could provide significant improvements over the prior art by diminishing struvite formation.

For the foregoing reasons, it would be desirable to produce a better non-flushing urinal solution; one in which less struvite is formed, especially in the area immediately around the transition from the cartridge or trap mechanism and the housing or plumbing entrance. The present invention overcomes these problems and provides a mechanism to both reduce the splashing of and increase the velocity of urine exiting a non-flush urinal cartridge.

BRIEF DESCRIPTION OF THE DRAWINGS

The objects, features and advantages of the present invention will be apparent from the following detailed descriptions of the various aspects of the invention in conjunction with reference to the following drawings, where.

SUMMARY OF THE INVENTION

Figure 1C:
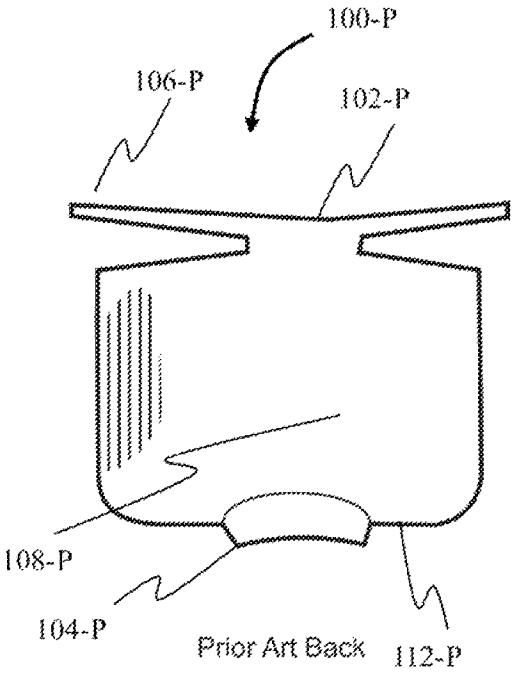
FIG. 1C PRIOR ART
FIGS. 1A-1C is a set of illustrations depicting a prior art cartridge, similar to the one manufactured and marketed by Falcon Waterfree Technology model C1M2+, in left (side), front, and back views.

The present invention relates to a waterless urinals and more particularly, to waterless urinal cartridges that include a mechanism to reduce the splashing of fluids exiting the cartridge into a housing or other connected plumbing elements in order to reduce precipitant buildup and to assist in cleaning.

In a first aspect, the present invention comprises a fluid exit portion for a splash-reducing urinal cartridge, where the exit portion includes a splash reducer for causing the fluid to exit the cartridge in a splash-reduced manner.

In another aspect, the splash reducer is a spout which may include a tapered exit area.

In still another aspect, the spout has converging fins that assist in urging fluid to collect in a progressively narrower channel.

In yet another aspect, the splash reducer is configured such that when the cartridge is installed in a urinal, the splash reducer urges fluid exiting the cartridge to flow in a direction selected from a group consisting of substantially parallel to an exit of a housing into which the cartridge is installed and proximate the splash reducer; and substantially parallel to building plumbing proximate the splash reducer; whereby the fluid exits the cartridge in a splash-reduced manner.

In a further aspect, the splash reducer is adjustable in a manner selected from a group consisting of being formed of a flexible material and being hinged with respect to a portion of the cartridge; thereby causing the cartridge to be easier to install.

In a still further aspect, the splash reducer includes a fluid exit portion. When the cartridge is installed in a housing the fluid exit portion resides in an location selected from a group consisting of below a bottom portion of the cartridge and below the bottom portion of the housing.

In a yet further aspect, the splash reducer further compromises a fluid flow surface for receiving flowing fluid and where the fluid flow surface is coated with a hydrophobic coating.

In another aspect, the splash reducer further comprises a fluid flow surface for receiving flowing fluid. The exit portion further comprises an exit wall for delivering fluid from the cartridge to the splash reducer such that fluid flowing from the exit wall encounters the splash reducer in a direction substantially parallel to the fluid flow surface at a location where the flowing fluid encounters the fluid flow surface. Thus, when fluid flows through the exit portion, the fluid handoff between the exit wall and the splash reducer is splash-reduced.

In yet another aspect, the present invention comprises a spout formed to increase the velocity of fluid exiting therefrom. The spout may be progressively tapered and may be configured to direct the fluid exiting therefrom toward a desired target.

Finally, as can be appreciated by one in the art, the present invention also comprises a method for forming and using the invention described herein.

DETAILED DESCRIPTION

The present invention relates to a waterless urinals and more particularly, to waterless urinal cartridges that include a mechanism to reduce the splashing of fluids exiting the cartridge into a housing or other connected plumbing elements in order to reduce precipitant buildup and to assist in cleaning.

The following description is presented to enable one of ordinary skill in the an to make and use the invention and to incorporate it in the context of particular applications. Various modifications, as well as a variety of uses in different applications will be readily apparent to those skilled in the art, and the general principles defined herein may be applied to a wide range of embodiments. For example, the individual components described may be formed as discrete parts or integrated together as a single unit. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of al such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Before describing the invention in detail, an introduction is provided to give the reader a general understanding of the present invention. Next, a description of various aspects of the present invention is provided to give an understanding of the specific details.

(1) Introduction

Non-flushing urinals use virtually no water, relying on one of two types of traps to seal out gas and odor, the first is a mechanical trap with a mechanical odor barrier, and the second is a liquid trap with a lighter-than-wastewater liquid barrier. The present invention is intended to overcome many of the shortcomings associated with both types of traps; an example being minimizing the buildup of struvite that tends to occur in the housing and the immediate drain pipe leg that connects the housing to the building's plumbing system by increasing the velocity of the flow and diminishing the splash of effluent which causes the formation of struvite.

The present invention accomplishes this in two ways. First, the path of the liquid effluent is constricted as it approaches the housing or building's drainage pipe. This constriction has the effect of increasing the exit fluid velocity. Second, it utilizes a malleable pour spout that can move out of the way during insertion (e.g., by flexing or hinging), then move back to is original configuration once insertion is completed. This is important because most housings currently in the market and already installed to accept a replacement cartridge have a trough area. This trough area can be an advantage as it keeps sewer backwash from entering the housing body and helps fluids drain away from the housing. However, in current systems, the trough area is generally around ½ to ¾ inches distant from the cartridge exit/drip edge, allowing fluids to splash which results in greater struvite buildup.

In order to clearly understand the benefits of the present invention, first features of current systems are presented. For clarity, reference numbers of elements referred to in the prior art figures are affixed with "-P." Corresponding similar elements in figures pertinent to the present invention are not affixed. Thus, for example, reference number 100-P is used to indicate a cartridge housing in prior art figures, whereas reference number 100 is used to indicate a similar element in figures used to show aspects of the present invention.

Figure 1B:
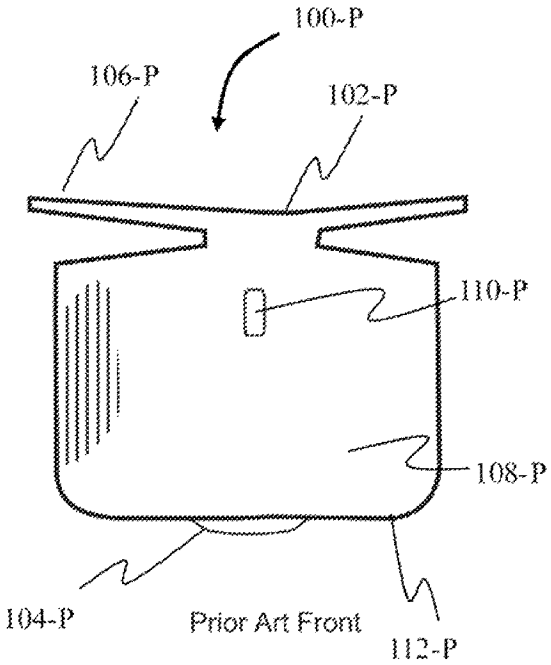
FIG. 1B PRIOR ART
Figure 1A:
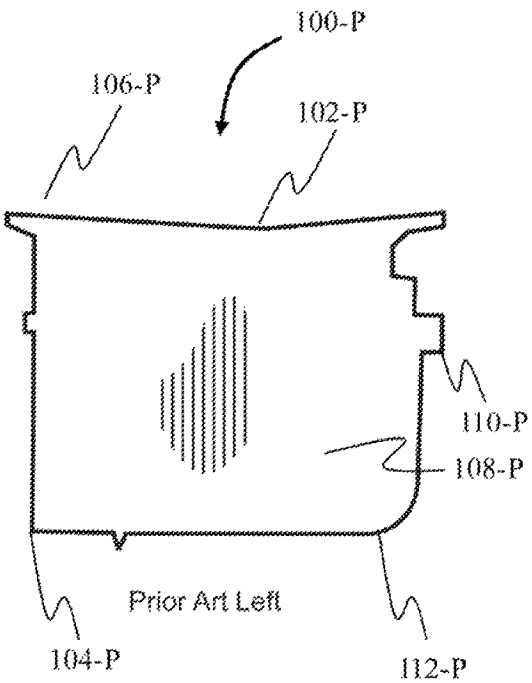
FIG. 1A PRIOR ART

An example of the exterior of a prior art cartridge 100-P is presented in FIGS. 1A to 1C. As shown in FIG. 1A, the cartridge 100-P includes a cartridge inlet 102-P for receiving incoming fluids and a cartridge exit 104-P for passing fluids out of the cartridge. The cartridge 100-P also includes atop wall flange 106-P for sealing the cartridge within a housing or a urinal (not shown). The cartridge 100-P further includes a cartridge side wall 108-P, that generally separates an exterior of the cartridge 100-P from an interior of the cartridge, as well as a locking tine 110-P for locking the cartridge 100-P within a housing or a urinal (again, not shown) and a bottom wall 112-P. The same exterior of the cartridge 100-P is shown in FIG. 1B in a front view and in FIG. 1C in a back view.

Figure 2:
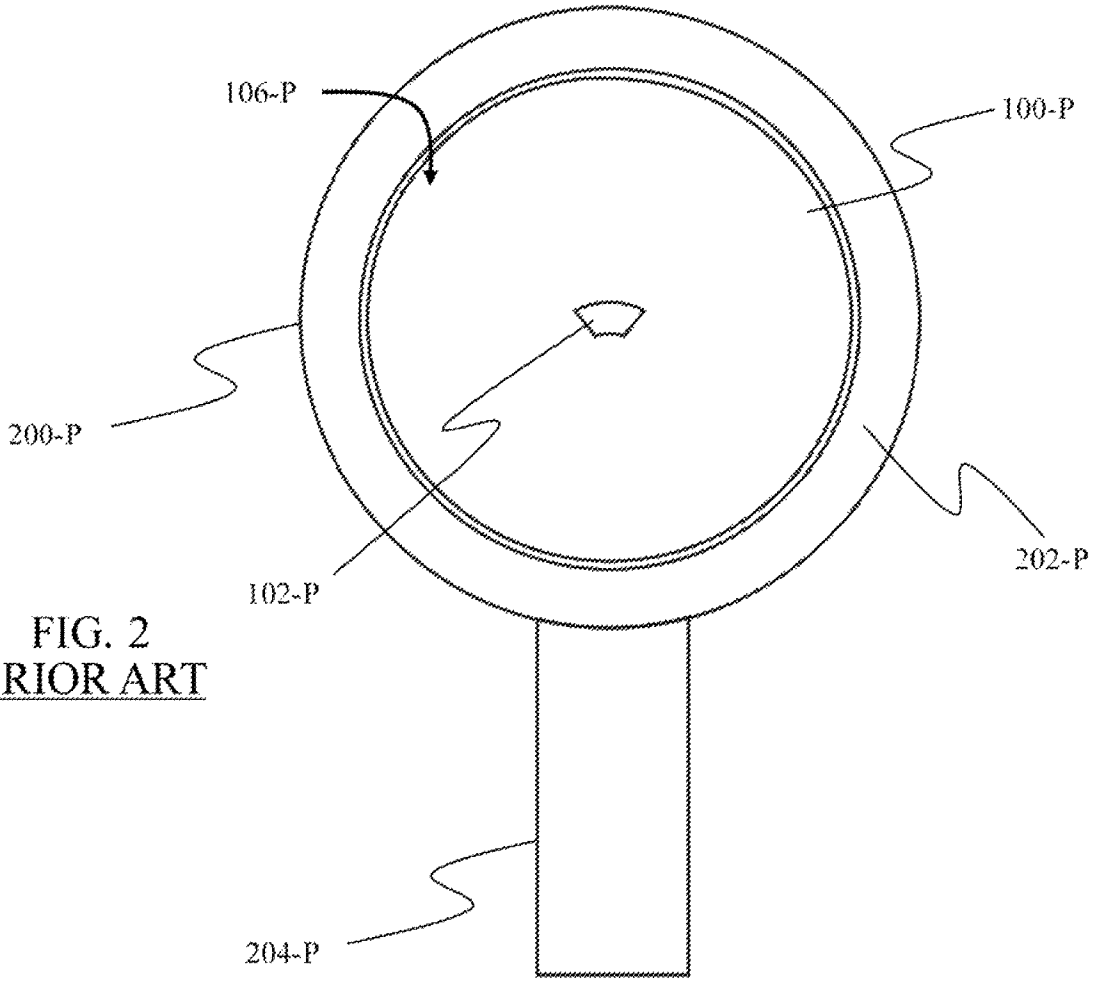
FIG. 2 PRIOR ART
FIG. 2 is a top view illustration depicting a prior art cartridge, similar to the one manufactured and marketed by Falcon Waterfree Technology model C1M2+, set in a prior art housing.

The same prior art cartridge 100-P is shown in FIG. 2 from a top view. In this view, the cartridge 100-P is shown inserted into a housing body 200-P having a housing flange 202-P. The cartridge exit 104-P (not shown) is aligned with a housing exit tube 204-P so that fluid entering the cartridge 100-P through the cartridge inlet 102-P and passing through the cartridge 100-P exits into the housing exit tube 204-P and then further into a building's plumbing (not shown).

Figure 3:
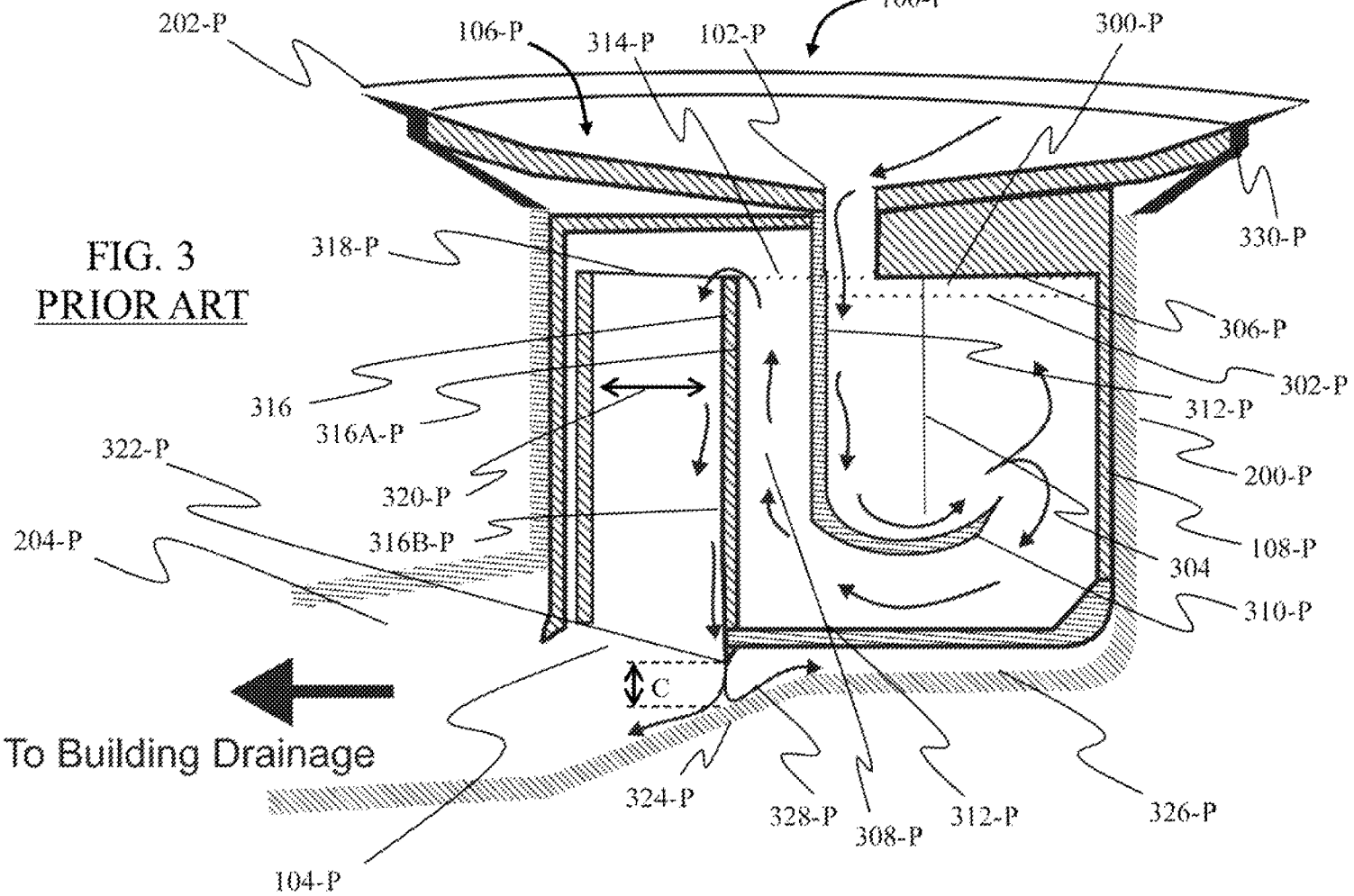
FIG. 3 PRIOR ART
FIG. 3 is an illustration of a cutaway side view of a prior art housing, with a prior art cartridge installed and the arrows depicting the flow of fluid through the cartridge and into the housing.

A cutaway cross-section side view of the cartridge 100-P is shown in FIG. 3, showing the interior components of the cartridge 100-P. After entering the cartridge 100-P through the cartridge inlet 102-P, urine passes through a fluid barrier layer 300-P having a fluid level 302-P and into an inlet compartment 304-P which resides beneath a cartridge ceiling 306-P. The inlet compartment 304-P is separated from an outlet compartment 308-P by a vertical separator 312-P. As urine flows through the cartridge 100-P, it passes through the inlet compartment 304-P, over a baffle 310-P and builds up within the cartridge 100-P, it rises within the outlet compartment 308-P, passing through a sealant layer 314-P, passing from a first side 316A-P of an outlet compartment vertical separator 316-P to a second side 316B-P of the outlet compartment vertical separator 316-P upon reaching an overflow level 318-P. After passing over the outlet compartment vertical separator 316-P, the urine enters a discharge section 320-P where it flows down the second side 316B-P of the outlet compartment vertical separator 316-P until it reaches an exit drip edge 322-P. From there, the urine drips or flows (depending on the volume) into a trough portion 324-P of a housing bottom 326-P. As urine falls across the gap C, between the exit drip edge 322-P and the surface of the trough portion 324-P, the falling urine results in struvite causing splashes 328-P. Note that the cartridge 100-P is shown sealed within the housing 220-P by use of an O-ring 330-P.

Figure 4B:
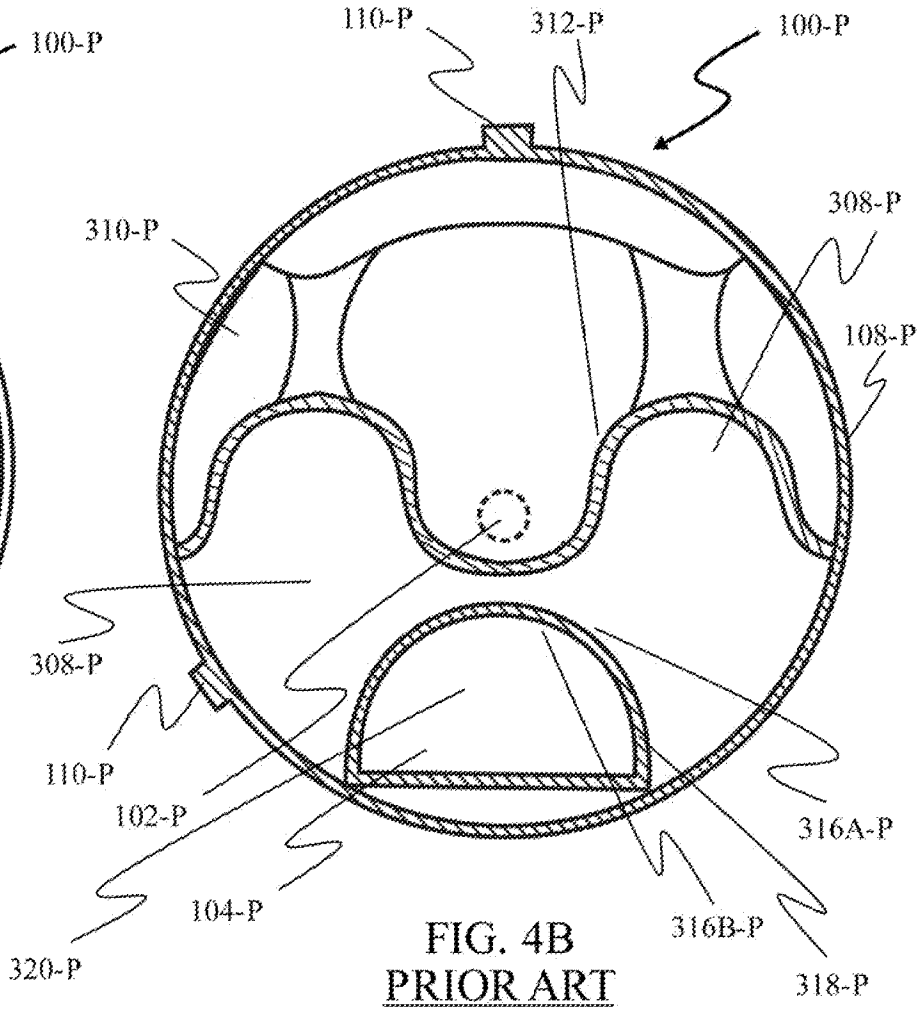
FIG. 4B PRIOR ART
FIGS. 4A and 4B are illustrations of a top view of a prior art cartridge and a cross-section of the cartridge taken just above the overflow level.
Figure 4A:
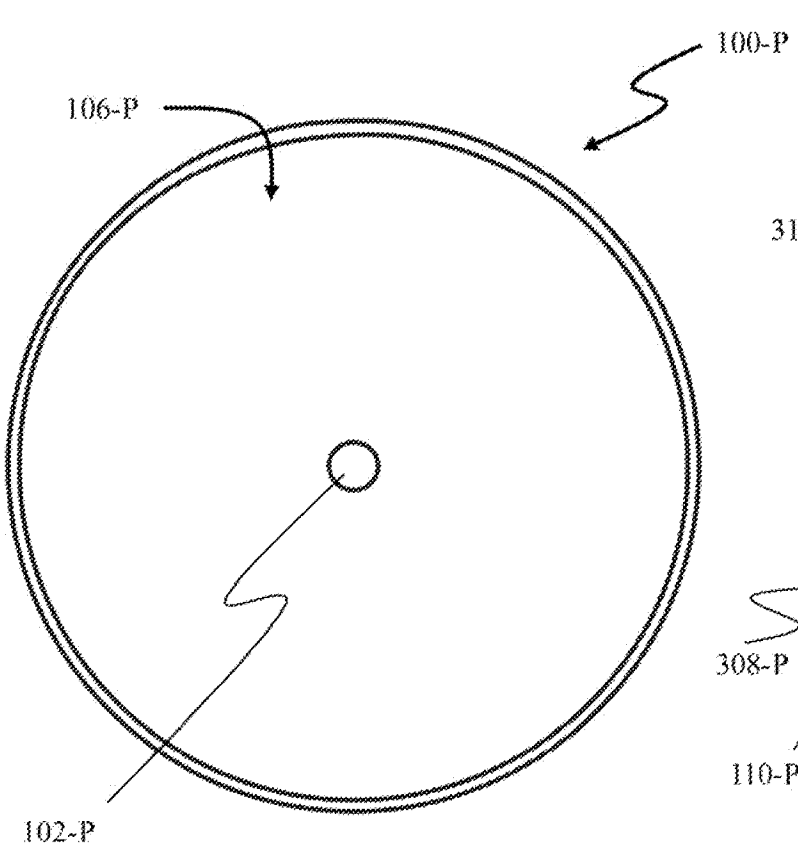
FIG. 4A PRIOR ART

A top view of a prior art cartridge 100-P is shown in FIG. 4A and a cross-section of the cartridge 100-P taken just above the overflow level 318-P is shown in FIG. 4B, looking down into the cartridge 100-P. The splashing and resulting struvite buildup in cartridges 100-P such as that just described is a major downside to such devices, resulting in greater replacement frequency and higher maintenance costs.

(2) Details of the Invention

Figure 5:
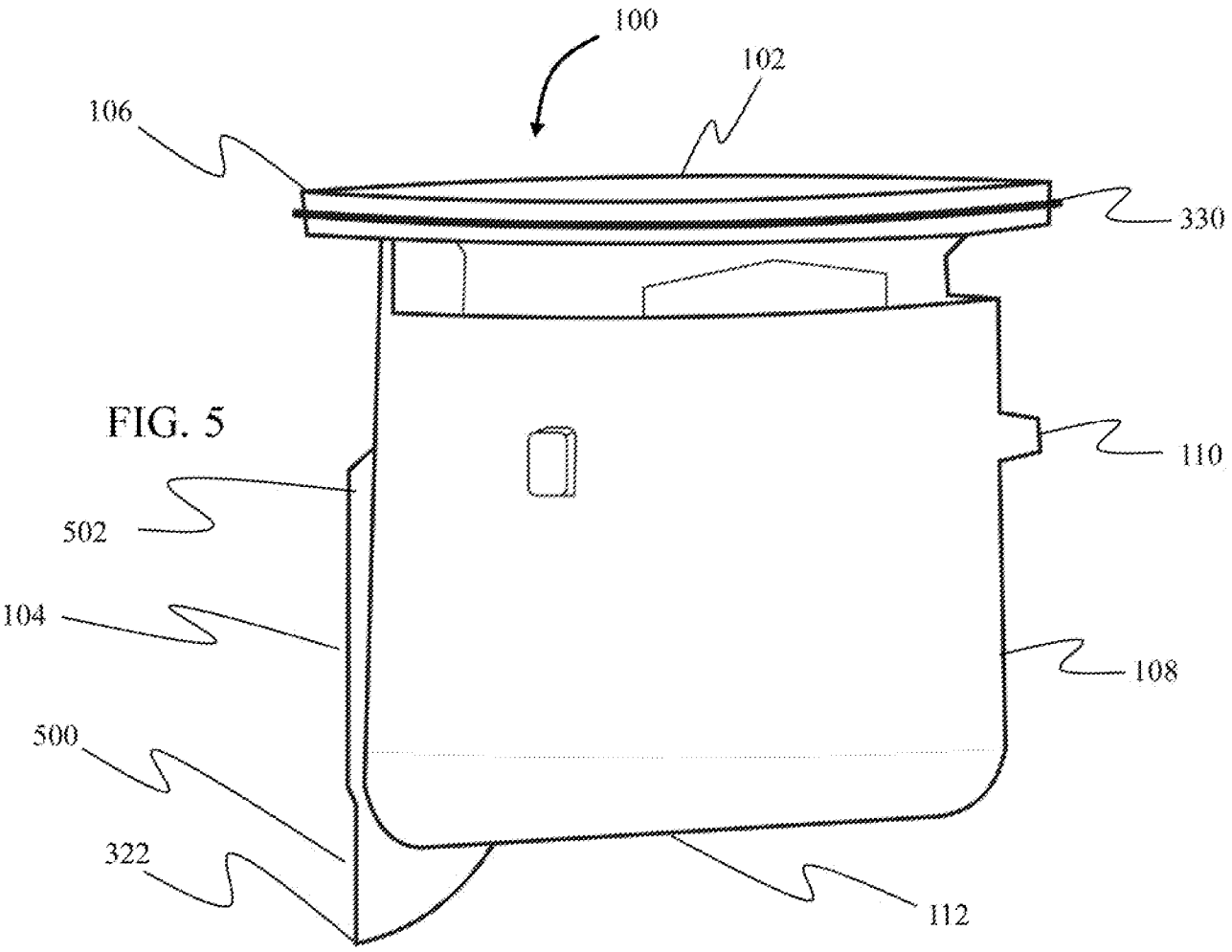
FIG. 5 is a side view illustration of a cartridge with an anti-splash exit, according to the present invention.

The present invention teaches an improved cartridge with a fluid exit portion configured to reduce splashing of and/or increase the velocity of urine exiting the cartridge into a housing and/or a building's plumbing. A side view of a cartridge 100 according to the present invention is shown in FIG. 5. Similar to the prior art cartridge 100-P described previously, this cartridge comprises a cartridge inlet 102 and a cartridge exit 104 with a top wall flange 106 formed about the cartridge inlet 102. The cartridge 100 further comprises an O-ring 330 provided about the top wall flange 106 to seal the cartridge 100 within a housing (not shown). Locking tines 110 are disposed about the exterior of the cartridge side wall 108 to lock the cartridge 100 within the housing (again, not shown). The cartridge 100 also includes a bottom wall 112. This version of the cartridge 100 further comprises a cartridge exit 104 having a pour spout 500 configured to conform with a housing (not shown) in order to minimize the distance (gap) between the exit drip edge 322 and the housing such that dripping is minimized. One or more wipers 502 are disposed about the cartridge wall 108. The wipers 502 protrude from the cartridge wall so that they can interact with the inside of a housing wall and wipe it clean as well as keep splash from getting inside of the housing when the cartridge 100 is inserted into the housing and during use.

It is desirable that the wipers 502 are made from a compliant material that can deform when it touches the inside of the housing wall Non-limiting examples of materials used in pluming that are flexible and would be good for making the wipers 502 include thermoplastic polyurethane (TPU), thermoplastic elastomers (TPE), and silicon. The wipers 502 can be attached with the cartridge 100 in a variety of ways, a non-limiting example includes injection molding them directly onto the cartridge (counting on both a mechanical and a molecular bond). This is a common process known as dual-injection or co-injection and it will be understood by anyone skilled in the art of injection molding Another non-limiting example of ways to attach the wipers 502 includes injection molding the wipers and then bonding them to the cartridge 100. This is accomplished in the post process using an appropriate resin capable of bonding the wiper material to the cartridge material. A still further non-limiting example of a way to attach the wipers 502 to the cartridge 100 is through welding using high frequency or other means to melt the two surfaces together.

Figure 6:
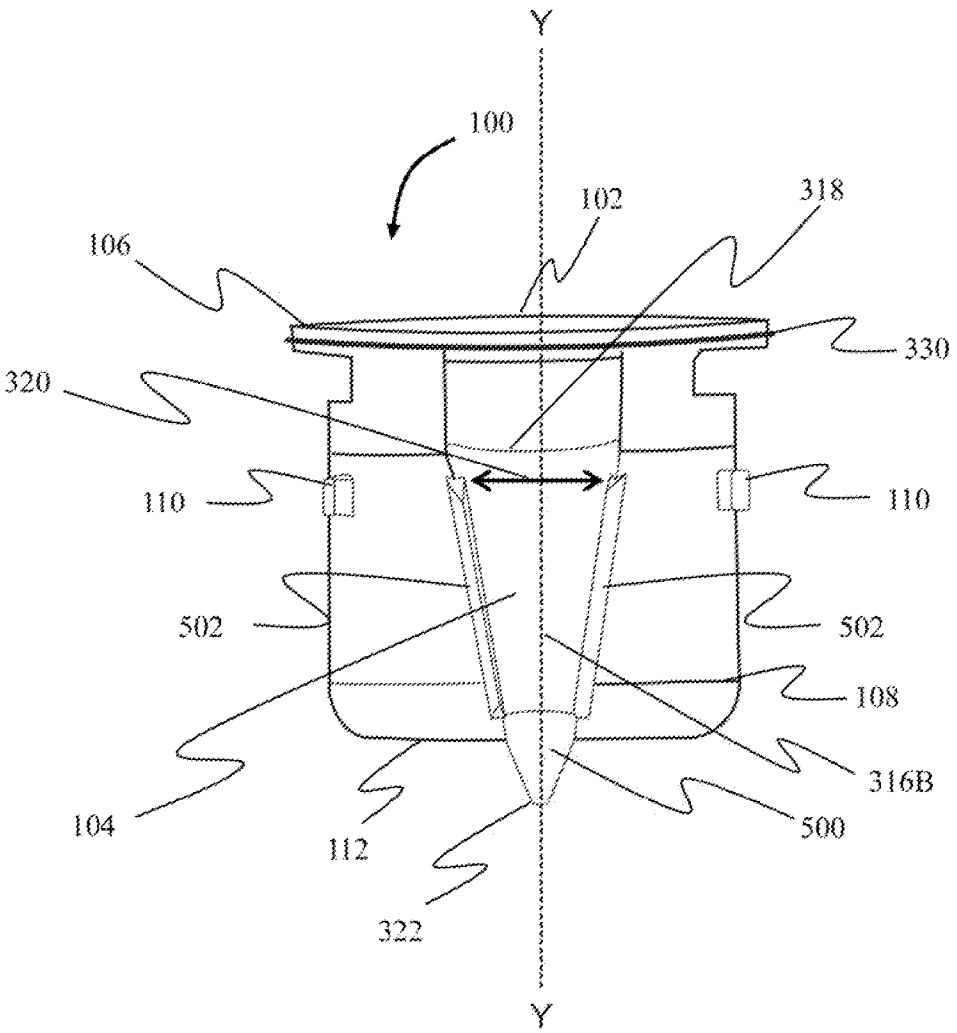
FIG. 6 is a front view illustration of a cartridge showing a cartridge exit with an anti-splash exit and wipers on either side of a discharge section at the exit, according to the present invention.
Figure 7:
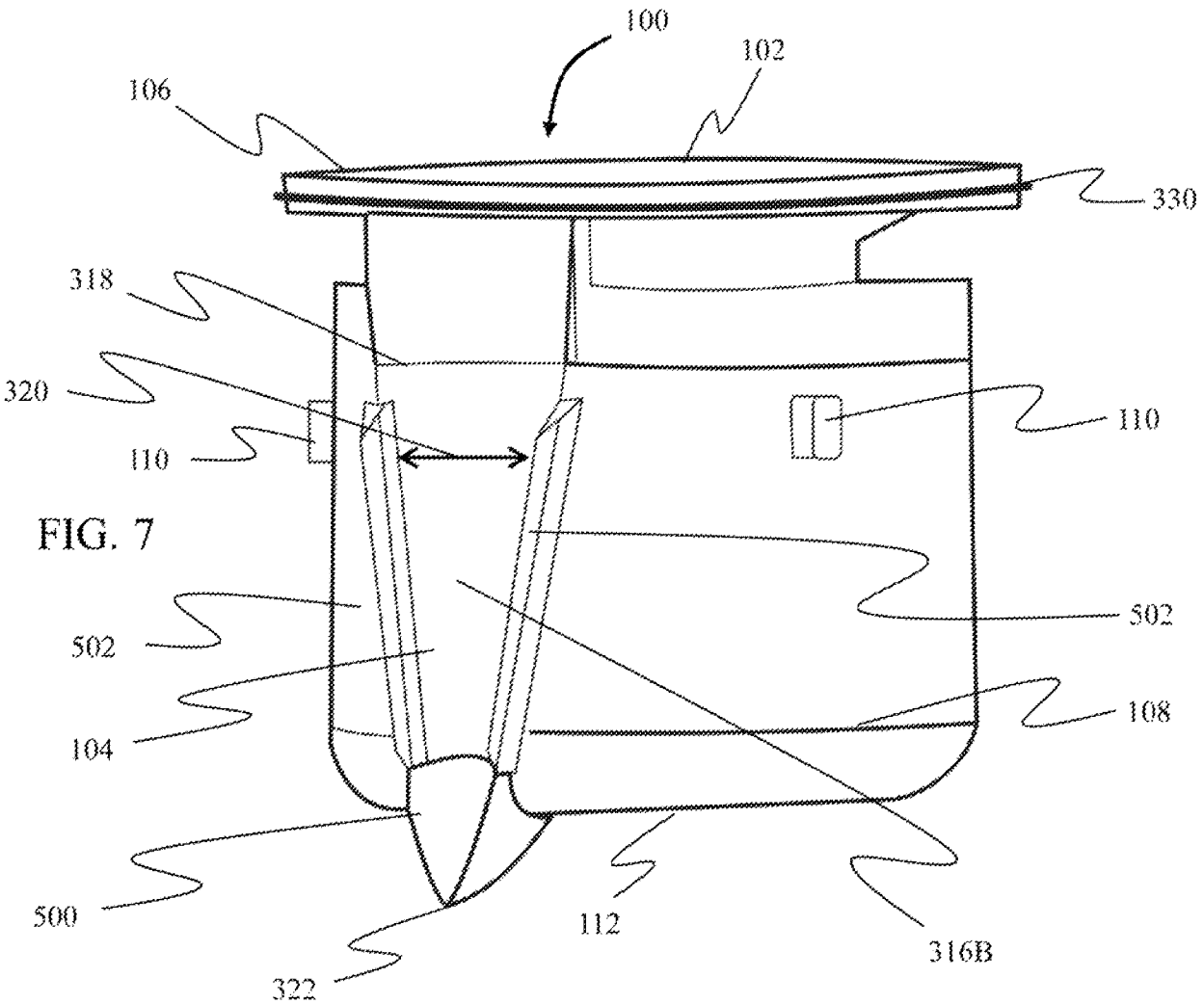
FIG. 7 is an isometric view illustration of a cartridge showing an anti-splash exit and wipers on either side of a discharge section at the exit, according to the present invention.

A rear view of the cartridge 100 of FIG. 5 is shown in FIG. 6 in side view and in FIG. 7 in an isometric view. In both of these figures, the pour spout 500 can be seen narrowing toward the exit drip edge 322. This assists in accelerating urine as it exits the cartridge 100, helping to prevent precipitation of struvite. Also, in both figures, the cartridge 100 can be seen having two wipers 502, which is a desirable configuration.

Figure 8:
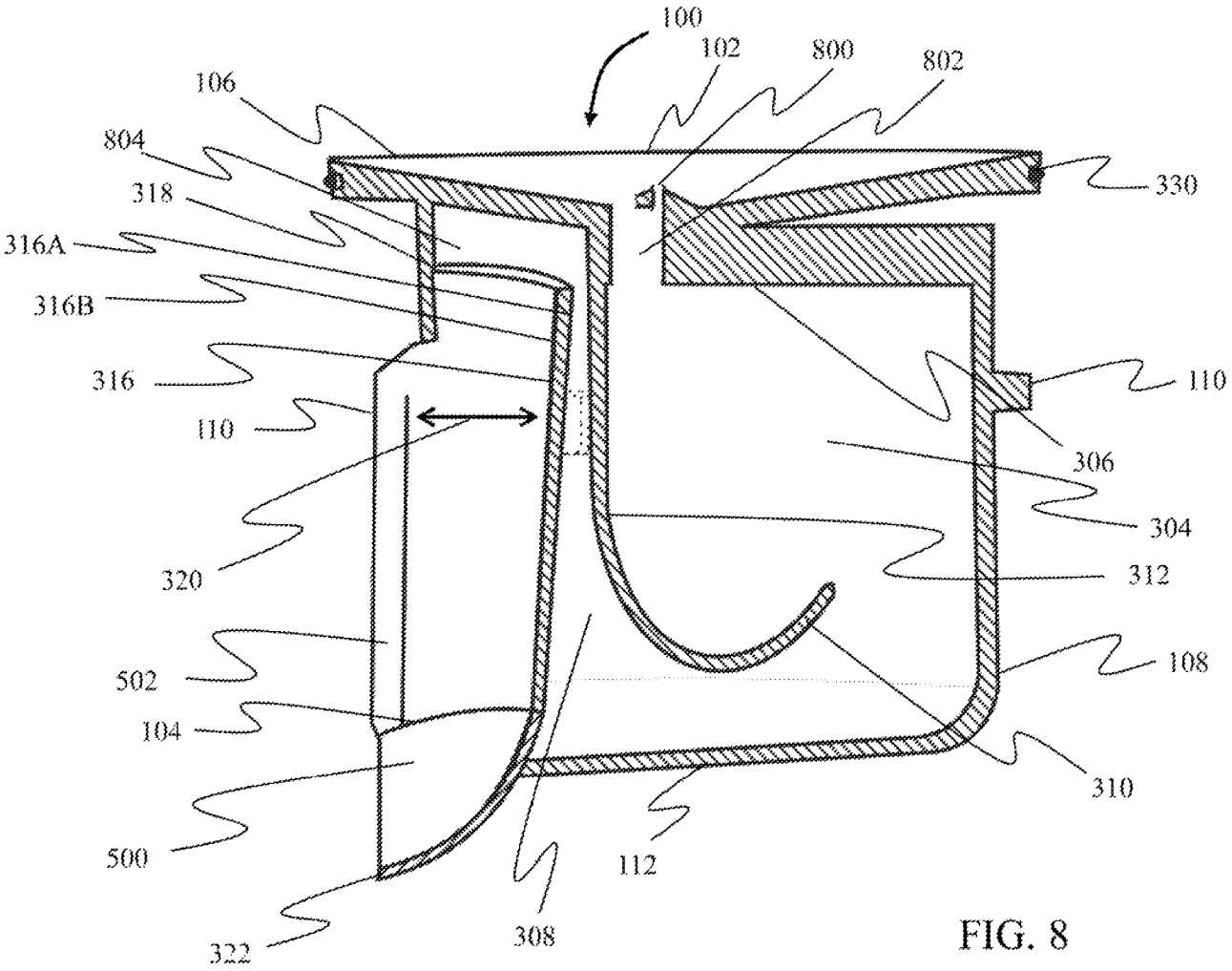
FIG. 8 is a cutaway side view illustration of the same cartridge shown in FIG. 7, according to the present invention.

The cartridge 100 of FIG. 5 is further shown in a cutaway view in FIG. 8. As with the prior art cartridge 100-P, this cartridge 100 comprises a cartridge inlet 102 for receiving urine. In this example, a vent 800 is disposed proximate the cartridge inlet 102. Urine passes through the cartridge inlet 102 into a throat portion 802 and into an inlet compartment 304 which lies within the cartridge between a cartridge side wall 108 and a vertical separator 312, roughly above a baffle 310 and beneath a cartridge ceiling 306. The cartridge 100 further comprises a locking tine 110 for securing the cartridge 100 within a housing (not shown) as well as an O-ring 330 proximate a top wall flange 106 for creating a fluid-tight seal with the housing (again, not shown). As the urine flows through the cartridge 100, it passes between the baffle 310 and a bottom wall 112, into an outlet compartment 308, where it rises along an outlet compartment vertical separator first side 316A to an overflow level 318, where it flows over to an outlet compartment vertical separator second side 316B. An overflow gap 804 is formed above the outlet compartment vertical separator 316 to enable urine to pass over the outlet compartment vertical separator 316 and into a discharge section 320. According to the present invention, the outlet compartment vertical separator 316 may be angled to permit urine to flow with minimal disturbance. Also according to the present invention, a pour spout 500 is formed at proximate the bottom of the outlet compartment vertical separator 316 at the cartridge exit 104 for directing the urine from the exit drip edge 322 of the pour spout 500 into a housing (not shown) or into a building's plumbing with minimal splashing at the interface therebetween (thus minimizing struvite precipitation). Also, at least one wiper 502 is formed proximate the discharge section 320 of the cartridge 100.

Figure 9:
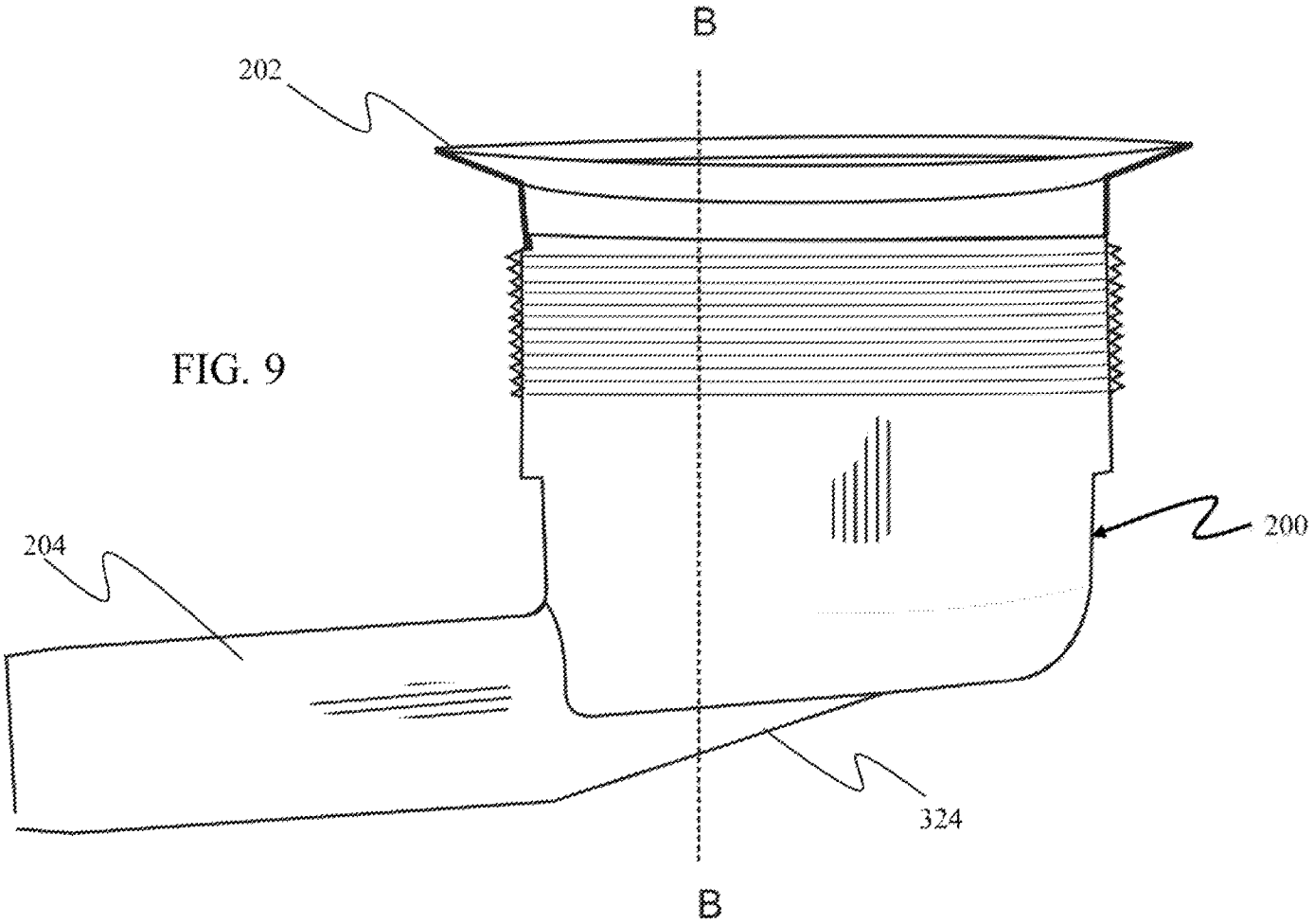
FIG. 9 is a side view illustration of a housing body and a housing exit tube, according to the present invention.

An external side view of a housing body 200 for receiving a cartridge 100 according to the present invention is presented in FIG. 9. The housing comprises a housing flange 202 that, when in use forms a fluid-tight seal with a urinal body (typically porcelain, not shown). As shown, the housing body 200 further comprises a housing trough 324 for receiving urine from the drip edge of the pour spout of a cartridge. After passing through the housing trough 324, urine continues to move through a housing exit tube 204 and then into a connected plumbing system (not shown).

Figure 10:
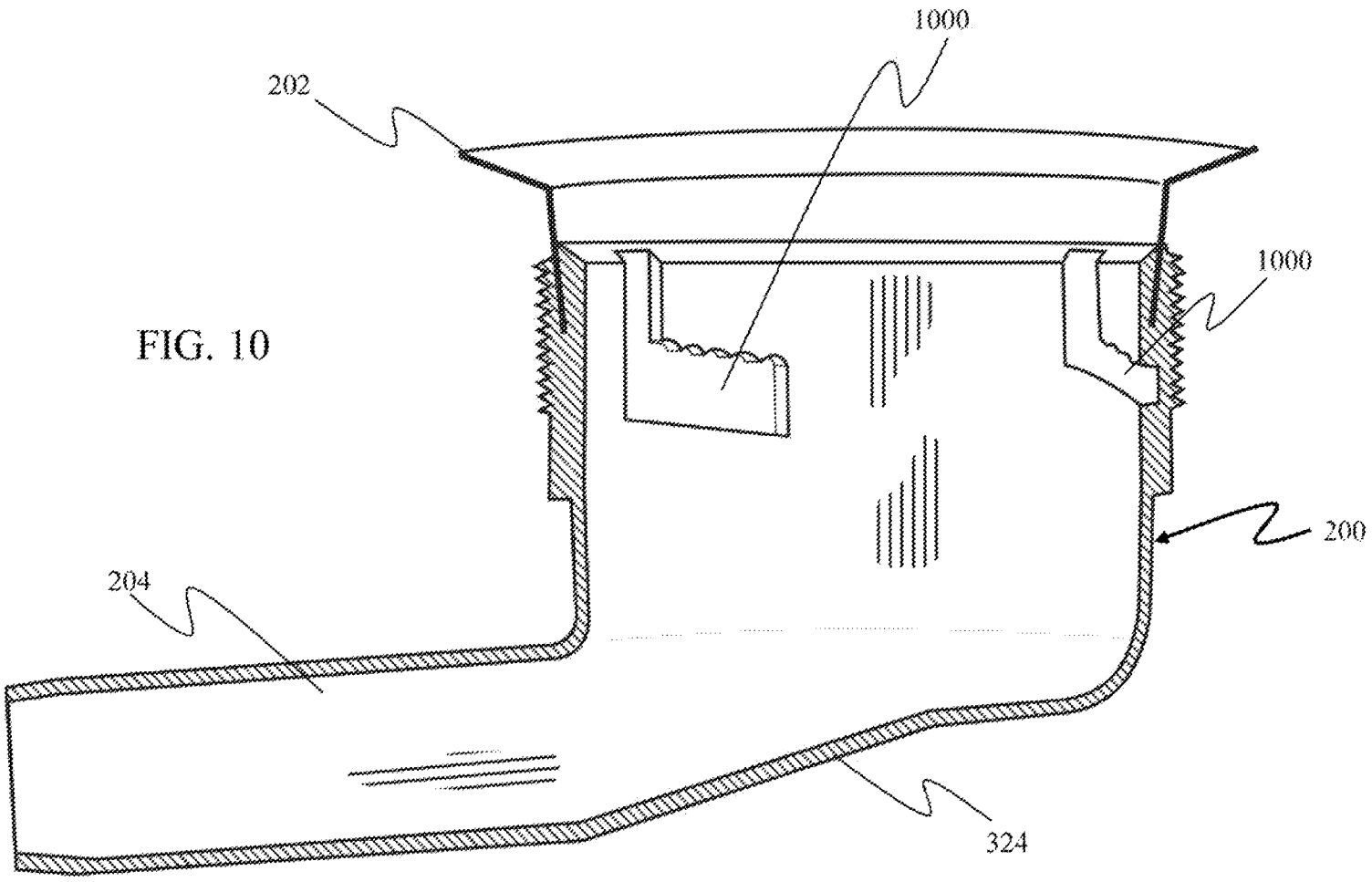
FIG. 10 is a cutaway side view illustration of the housing from FIG. 9, according to the present invention.
Figure 11:
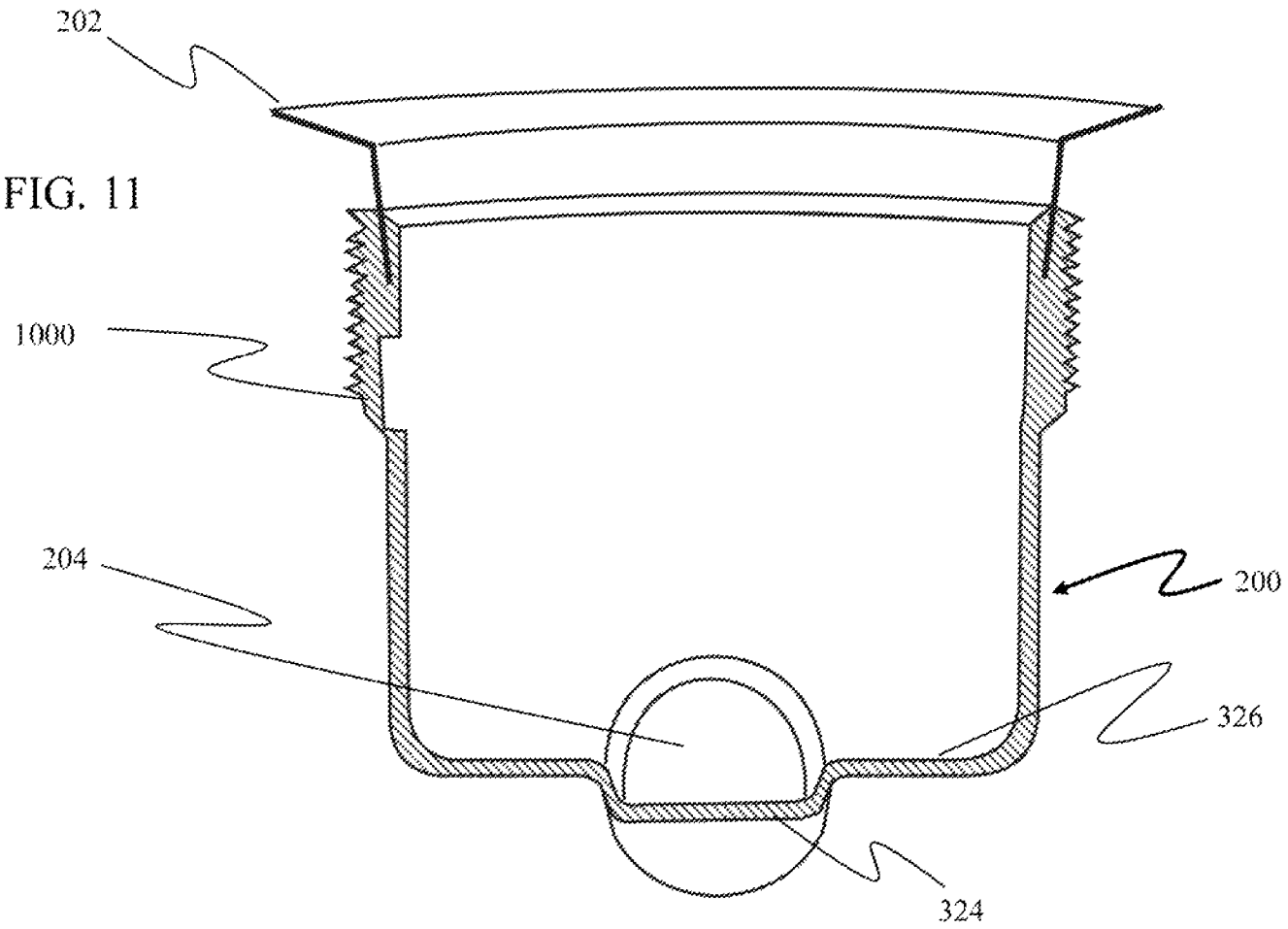
FIG. 11 is a front view cross section illustration of a housing as shown in FIG. 9, cutaway along the line B-B and rotated 90 degrees, according to the present invention.

A cross-sectional cutaway side view of the housing body 200 of FIG. 9 is shown in FIG. 10. In this case, locking tine keyways 1000 are visible. The locking tine keyways 1000 are configured to connect with the locking tines 110 of the cartridge 100 (not shown) to retain the cartridge 100 securely within the housing body 200. A front view cross-sectional view of the housing body 200 of FIG. 10 is shown in FIG. 11. In this figure, it is apparent that a housing bottom 326 resides above a bottom of the housing exit tube 204, which is generally sloped downward to permit urine to flow out of the housing body 200.

Figure 12:
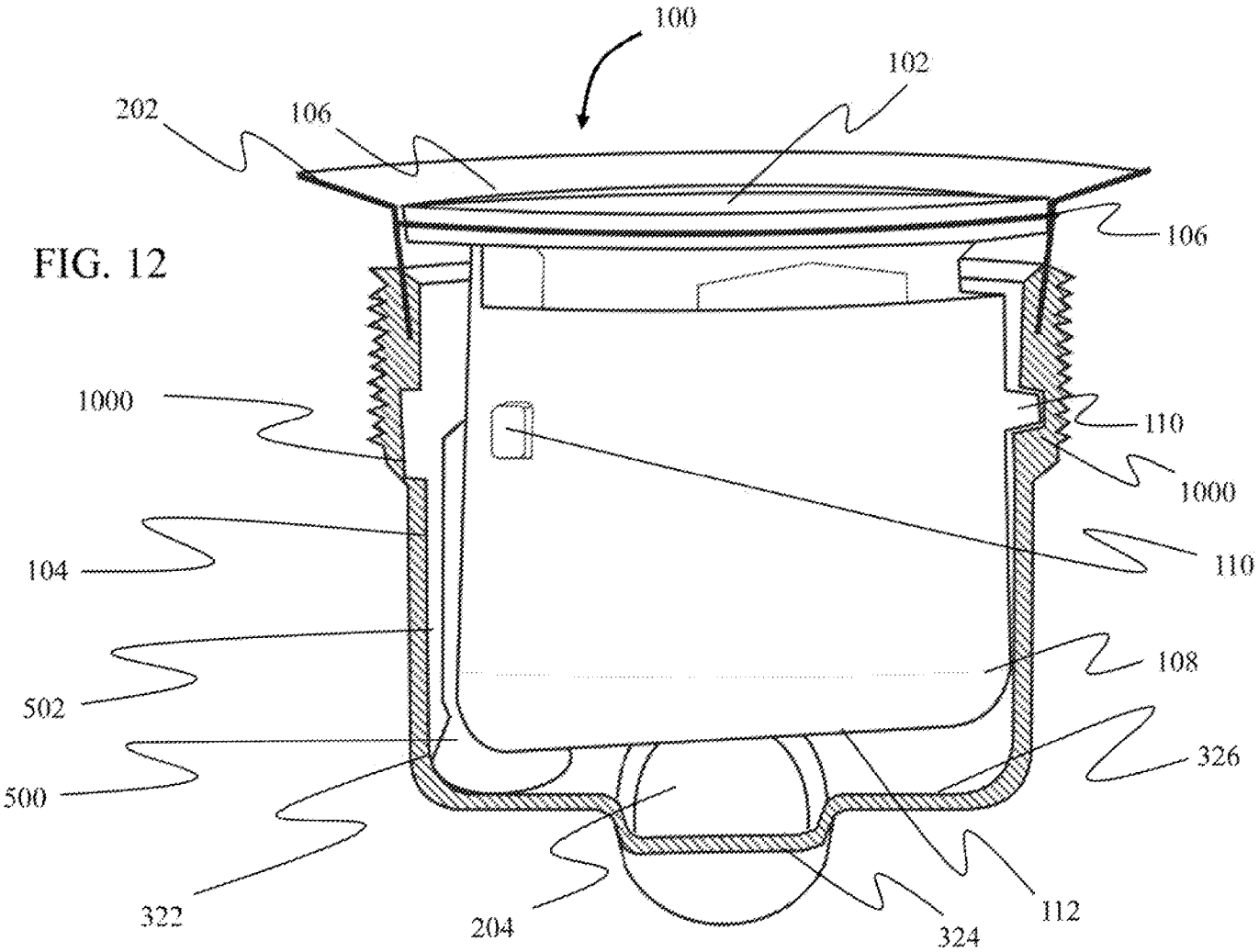
FIG. 12 is an illustration of a cutaway front view of the housing as seen in FIG. 11, with a non-cutaway cartridge with the present invention, as it is first inserted and before it is turned and locked in position according to the present invention.

A front cross-sectional view of the housing body 200 of FIG. 10 is shown in FIG. 12 with an external view of the cartridge 100 of FIG. 5 inserted therein. In particular, this figure shows the configuration of the cartridge 100 and the housing body 200 when the cartridge 100 is first inserted therein. In order to connect the locking tines 110 of the cartridge 100 with the locking tine keyways 1000 of the housing body 200, cartridge 100 is inserted into the housing body 200 without the pour spout 500 being in-line with the housing exit tube 204 (and thus, miss-aligned with respect to the housing trough 324). As shown, the pour spout 500 is compliant with regard to the interior of the housing body 200 during insertion and then, as the cartridge 100 is rotated so that the pour spout 500 aligns with the housing trough 324, the pour spout 500 changes in configuration to minimize the splashing/dripping of urine between the exit drip edge 322 of the pour spout 500 and the housing body 200. This can be accomplished in many ways, non-limiting examples of which include forming the pour spout 500 of a flexible material so that it flexes as the cartridge 100 is inserted into the housing body 200 and then regains a shape the splashing/dripping of urine between the exit drip edge 322 of the pour spout 500 and the housing body 200; and hinging the pour spout 500 so that it moves as the cartridge 100 is inserted into the housing body 200 and then moves back into a configuration that minimizes the splashing/dripping of urine between the exit drip edge 322 of the pour spout 500 and the housing body 200.

Figure 13:
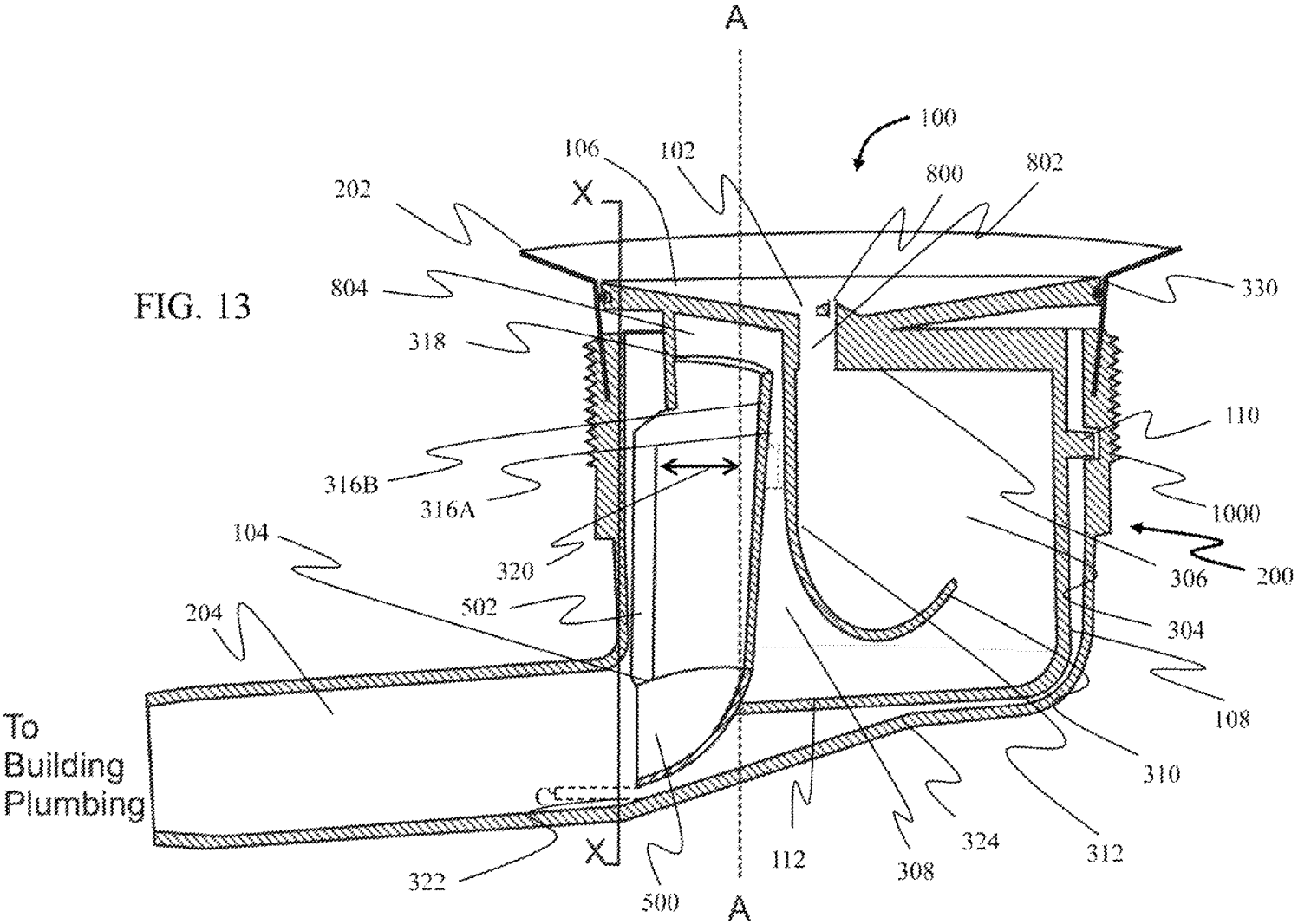
FIG. 13 is a cutaway side view illustration of the same cartridge shown in FIGS. 5-8, now placed in a housing, according to the present invention.

A side cross-sectional view of the housing body of FIG. 10 is shown in FIG. 13 with a cross-sectional view of the cartridge 100 of FIG. 8 inserted therein after the cartridge 100 has been turned so that the locking tines 110 of the cartridge 100 engage with the locking tine keyways 1000 of the housing 200. In this case, the pour spout 500 has expanded so that the exit drip edge 322 is very close to the housing trough 324 in order to minimize the distance C and thus minimize the splashing of urine as it contacts the housing trough 324.

Figure 14:
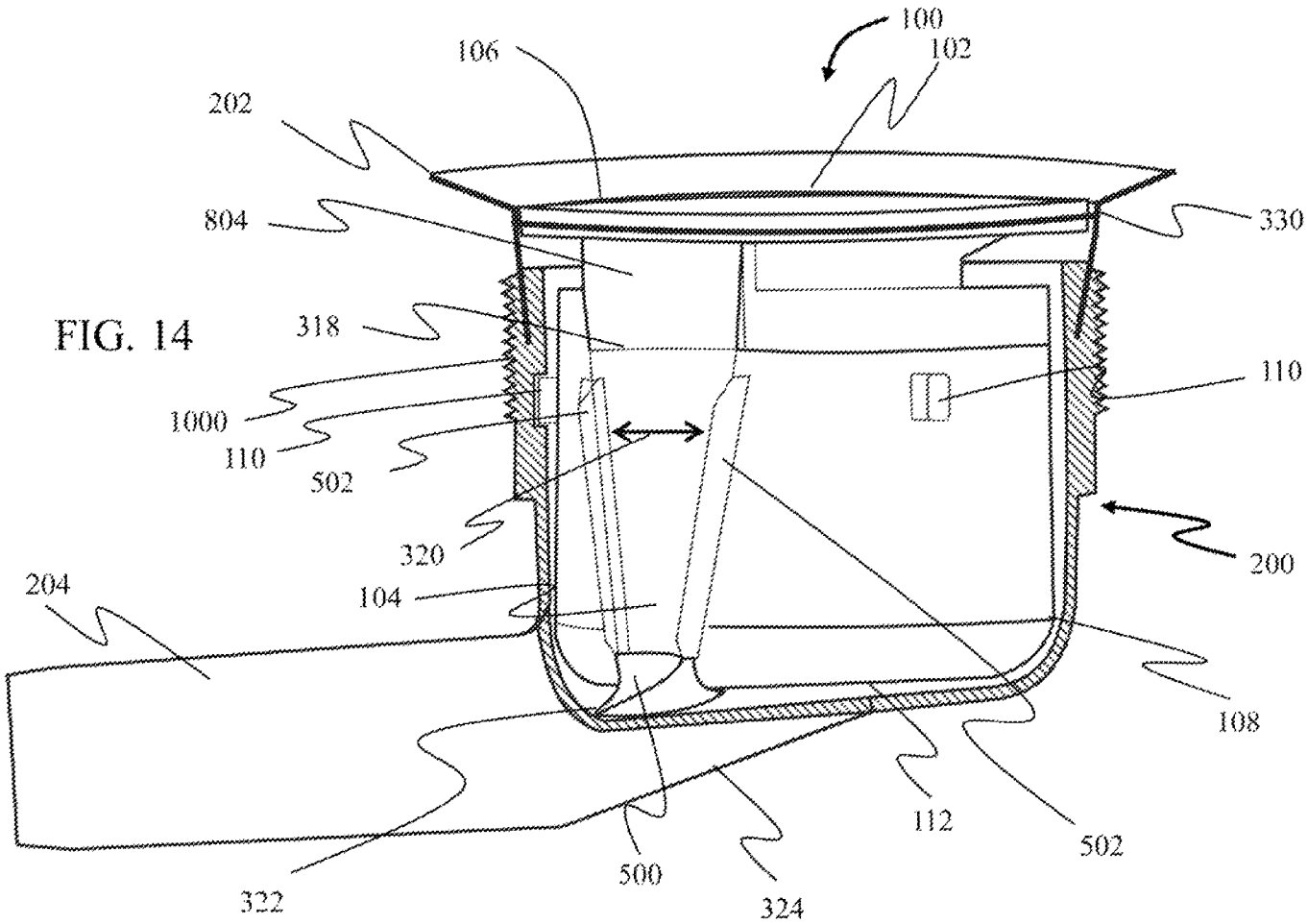
FIG. 14 is a cutaway side view illustration of the cartridge shown in FIG. 13, with the cartridge shown during the process of insertion, according to the present invention.

A side cross-sectional view of the housing body 200 of FIG. 10 is shown in FIG. 14 with an external view of the cartridge 100 of FIG. 5 therein. In this case, the cartridge 100 is in the process of being inserted into the housing 200, prior to the locking tine 100 of the cartridge reaching the full depth and interlocking within its counterpart, the locking tine keyway 1000. The housing body 200 has been cutaway enough to show how the pour spout 500 interferes with the bottom of the housing body 200. This is because the housing trough 324 is only in the central portion of the housing body 200, aligned with the housing exit tube 204; and thus, the housing trough 324 does not extend along the entire bottom of the housing body 200. The pour spout 500 can be seen deforming to allow insertion of the cartridge 100 into the housing body 200. The pour spout 500 is formed of a flexible material, which allows the pour spout 500 to deform or flex out of the way when it contacts the housing body 200 prior to being twisted fully into place as was shown in FIG. 13. By forming the pour spout 500 so that it can deform or flex out of the way when it comes into contact with the housing body 200, it can be elongated so that it fits deeply into the housing trough 324 as was shown in FIG. 13, while still permitting the cartridge 100 to use a twisting method of insertion and locking.

When the cartridge 100 needs to be replaced or when the system of the present invention is initially installed, maintenance personnel will place the cartridge 100 into the housing body 200 and rotate the cartridge 100 until the locking tines 110 of the cartridge 100 fully engage the locking tine keyways 1000 of the housing body 200. In the process of rotation, the wipers 502 will clear off at least some wastewater buildup on the inside of the housing body 200. Upon full engagement, the wipers 502 prevent splash and restrain wastewater from leaving the discharge section 320 and the housing exit tube 204.

Figure 15:
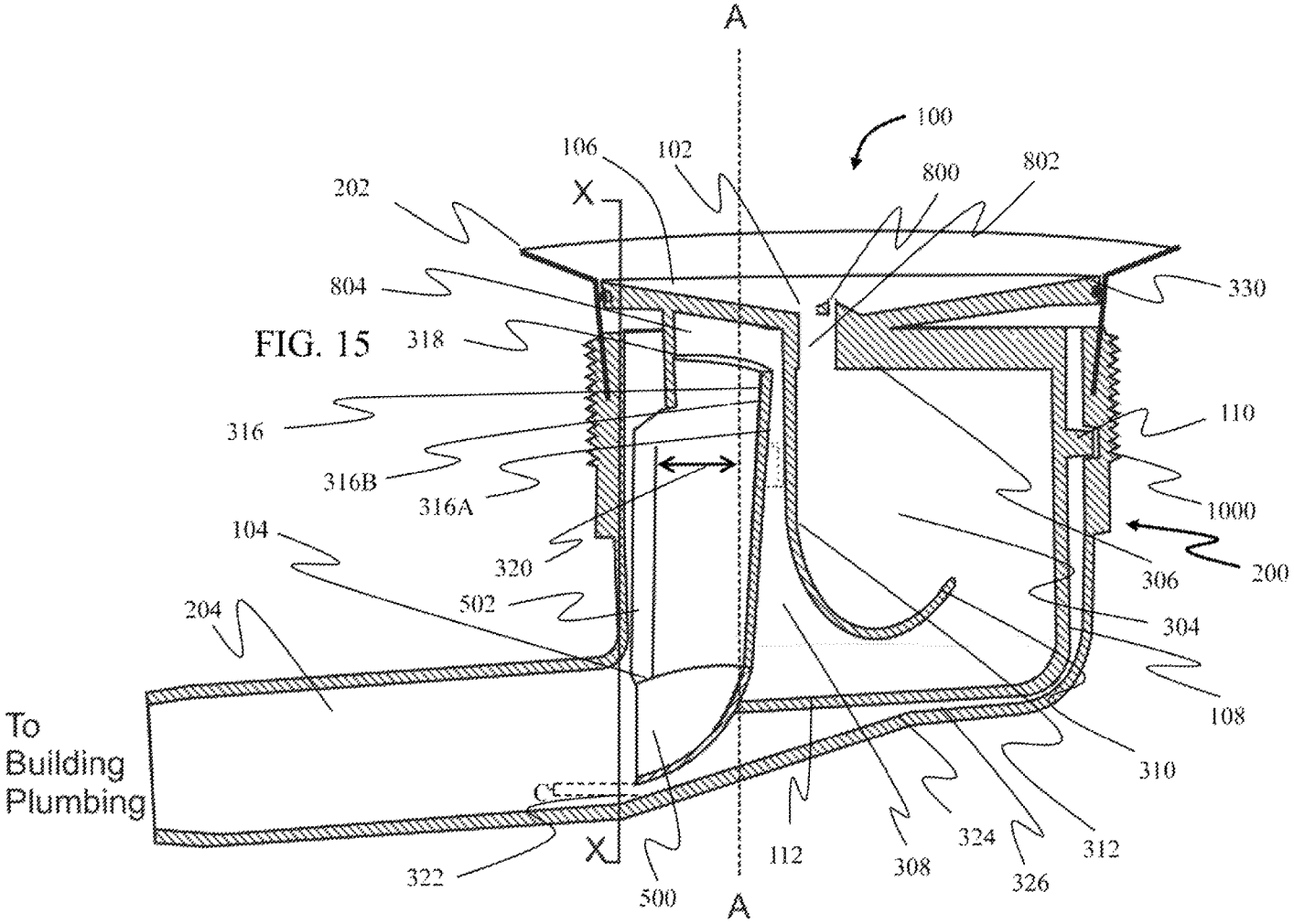
FIG. 15 is an illustration of a cutaway side view of a cartridge and a housing, with the arrows depicting the fluid path through the cartridge, according to the present invention.

The cutaway view shown in FIG. 13 is shown again in FIG. 15 with arrows showing the fluid path through the cartridge. Effluent (also referred to as urine or wastewater) enters the cartridge 100 through the inlet 102 and passes through the throat 802 and into the inlet compartment 304. The liquid then flows around and underneath the baffle 310 and enters the outlet compartment 308, and then rises until it goes over the top of the overflow 318. The liquid then flows down the cartridge exit 104 which has a tapered and generally U-shape which causes the liquid to stay mostly central as it descends down the cartridge exit 104. The fluid eventually enters the spout 500 at the bottom of the cartridge exit 104 and is diverted to a substantially horizontal direction as it exits the cartridge 100 and enters the housing exit tube 204. The exit drip edge 322 is only a few millimeters away from the trough 324, as indicated by the distance C. The distance C can be brought to zero if desired, as the soft pour spout 500 can deflect slightly to create a seal with the trough 324, leaving no distance for splashing to occur between the pour spout 500 and the trough 324.

Still referring to FIG. 15, when the cartridge 100 is in use, a user and the shape of the attached urinal (not shown) will direct the urine toward the cartridge 100. The downward slopes created by the top wall flange 106 guide the urine through the inlet 102 and the throat 802 and into the inlet compartment 304. In the case where the cartridge uses a liquid sealant, the urine will also pass through and beneath a liquid sealant layer present within the cartridge 100, which blocks odors from the sewer and from the wastewater itself from entering the restroom. As more urine enters the inlet compartment 304, older urine is forced under the baffle 310, into the outlet compartment 308, and over the outlet compartment vertical separator 316, into the discharge section 320. Since this portion (the outlet compartment 308 and beyond) of the cartridge 100 would essentially be the same whether a mechanical trap system or a liquid barrier system is employed, only the liquid system is discussed. In prior art units, at this stage the wastewater would fall straight, creating a splashing area and depositing struvite and other undesirable precipitants. According to the present invention, the cartridge exit 104 is tiled off the vertical axis, as shown by the angle between the vertical separator 316 and the line A-A. For this reason, the wastewater stays in contact with the cartridge exit 104. The cartridge exit 104 is generally U-shaped, which helps to centralize the fluid. About the overflow level 318, the flow area is also generally U-shaped, with its outermost edges being higher than the base.

Figure 16B:
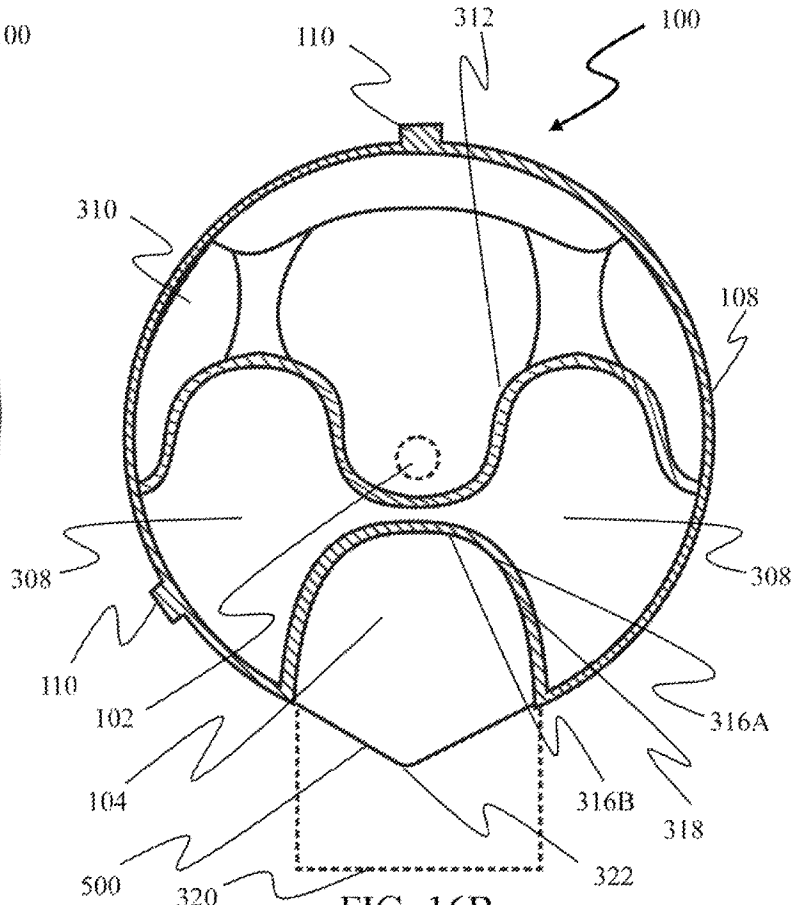
FIGS. 16A and 16B are the top view illustrations of a central inlet cartridge and a cross section from the same top view of the same cartridge, according to the present invention.
Figure 16A:
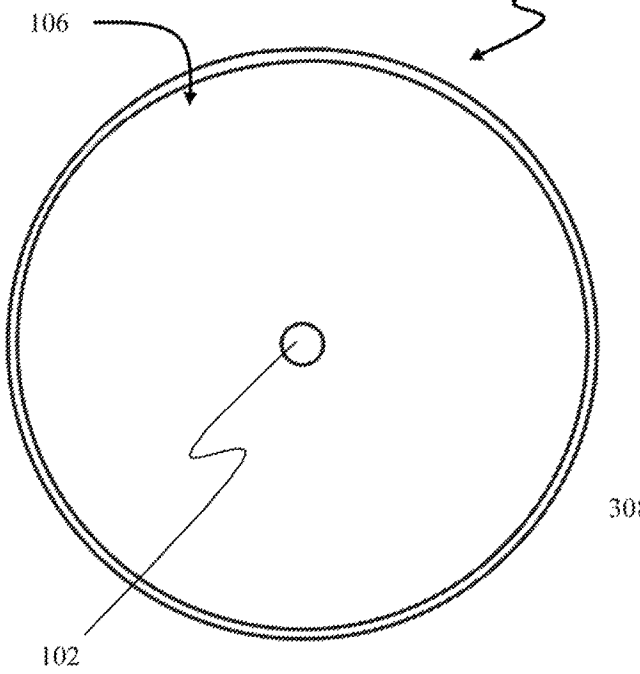

A top view of the cartridge 100 of FIG. 8 is shown in FIG. 16A and a cross-sectional view of the same cartridge 100 taken just below the ceiling 306 is shown in FIG. 16B. The cartridge 100 has a baffle 310 and an inlet compartment 304 which surrounds an outlet compartment 308. The cartridge exit 104 has a generally U-shaped cross section which serves to centralize fluid as it passes the overflow level 318.

Figure 17:
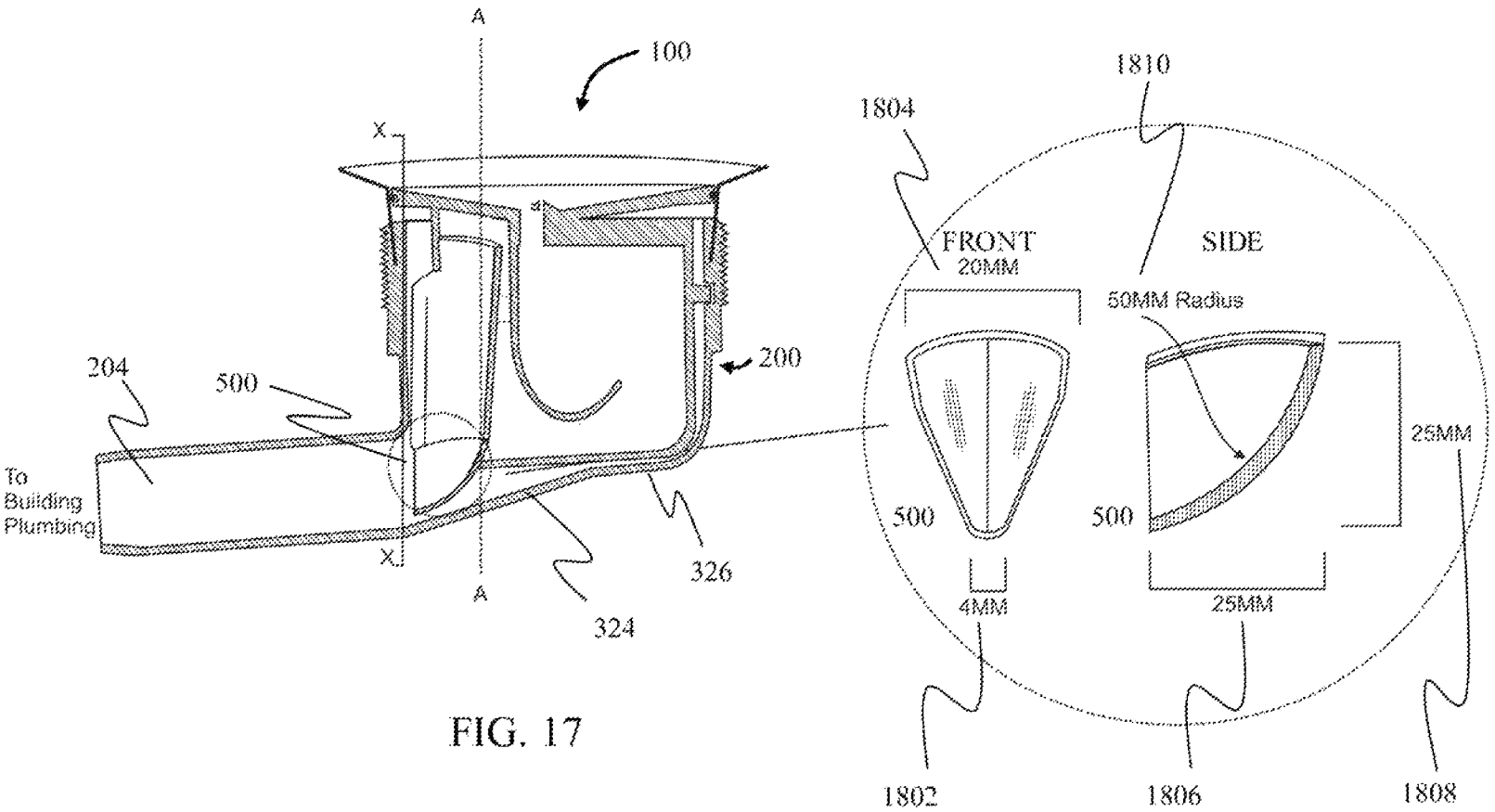
FIG. 17 is an illustration of a blown-up side cutaway view and a front view of a pour spout, according to the present invention.

The cartridge 100 and the housing 200 of FIG. 15 are shown in FIG. 17 along with sample dimensions for the pour spout 500. Both a front view and a side cross-sectional view of the pour spout 500 are shown within the dotted line circle. The pour spout 500 can be made to flex in any number of ways. In this version, the pour spout 500 is flexible due to being formed from a compliant material with a memory that can deform when it touches the housing bottom 326 and then returns to its original form when the cartridge 100 is rotated and locked within the housing 200 such that the pour spout 500 is aligned with the housing trough 324. Non-limiting examples of materials used in plumbing that are flexible and would be good for making the pour spout 500 include thermoplastic polyurethane (TPU), thermoplastic elastomers (TPE), and silicon. The pour spout 500 can be attached with the cartridge 100 in a variety of ways, a non-limiting example includes injection molding them directly onto the cartridge (counting on both a mechanical and a molecular bond). This is a common process known as dual-injection or co-injection and it will be understood by anyone skilled in the art of injection molding. Simply stated, a second material is injected over the first material and can be injected through holes, into a negative draft, or on to a textured surface, to help increase the bonding strength. Another non-limiting example of ways to attach the pour spout 500 include injection molding the wipers and then bonding them to the cartridge 100 in a post process, using the appropriate resin capable of bonding the wiper material to the cartridge material A still further non-limiting example of a way to attach the pour spout 500 to the cartridge 100 is through welding using high frequency or other means to melt the two surfaces together.

Figure 18:
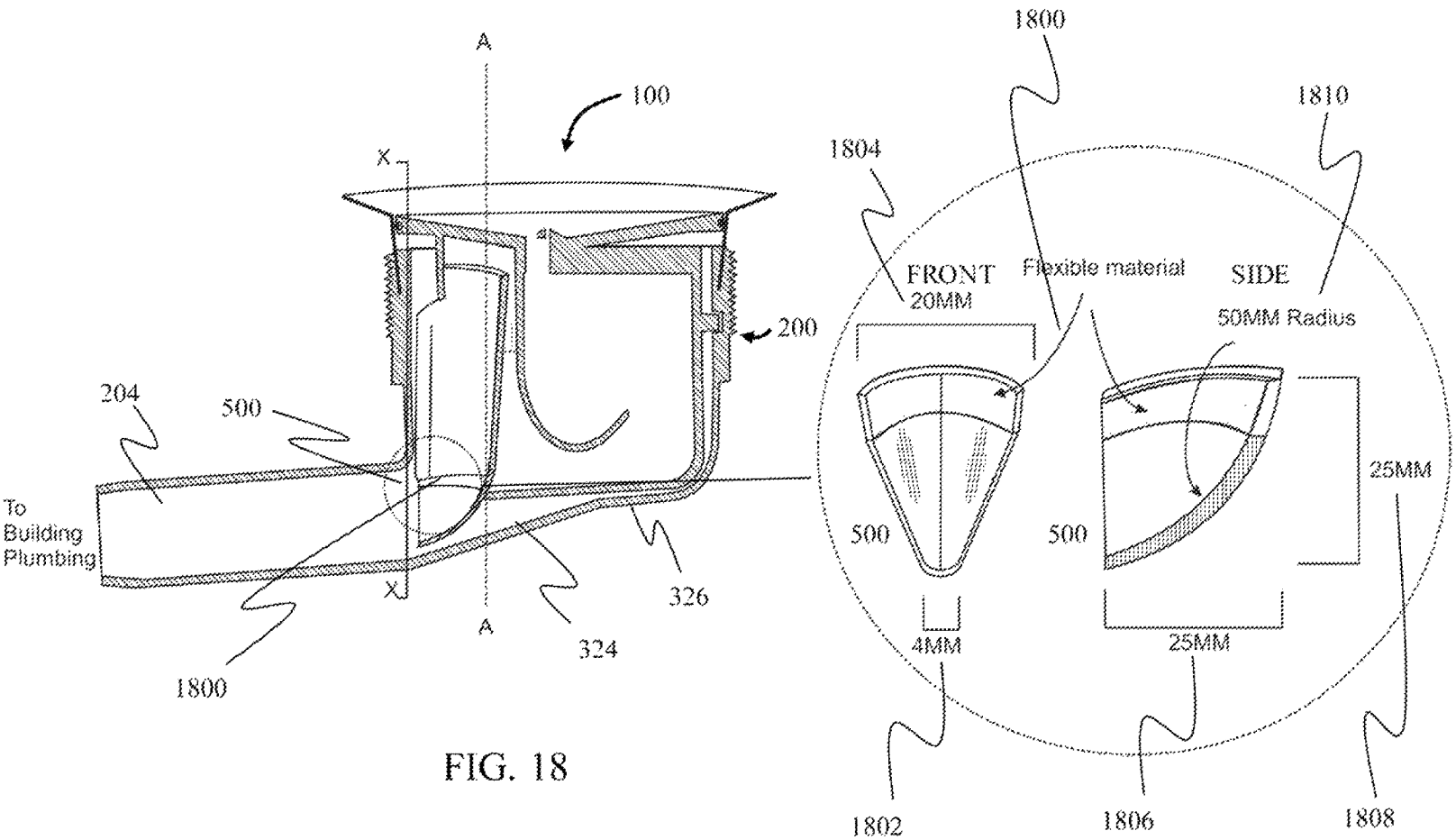
FIG. 18 is an illustration of a blown-up side cutaway view and a front view of a pour spout flexible via a hinge area, according to the present invention.

The cartridge 100 and the housing 200 of FIG. 15 are shown in FIG. 18 along with sample dimensions for another version of the pour spout 500. In this version, the pour spout 500 is able to flex via a hinge area 1800. A front view and a cross-sectional side view are shown within the dotted line circle. As a non-limiting example, the pour spout 500 may be formed from a similar material as the cartridge 100, with the hinge area 1800 connecting the pour spout 500 with the cartridge 100. The hinge area 1800 is shaded to indicate the flexible region. Any region large enough and flexible enough to allow the spout to fold out of the way when inserted into the housing is sufficient. In use, the pouring spout 500 touches the housing bottom 326 and the hinge area 1800 allows the pouring spout 500 to flex out of the way until it is aligned with the trough area 324. Non-limiting examples of materials used in plumbing that are flexible and would be good for making this version of the pour spout 500 again include thermoplastic polyurethane (TPU), thermoplastic elastomers (TPE), and silicon. The hinge material can be injection molded directly on to the cartridge 100 and the spout 500 to connect the two together. This can be done using either a mechanical and/or a molecular bond. This is a common process known as dual injection or co-injection and it will be understood by anyone skied in the art of injection molding Again, simply stated, a second material is injected over the first material and can be injected through holes, into a negative draft, or on to a textured surface, to help increase the bonding strength. The pour spout can also be injection molded, then bonded on to the cartridge in a post process, using the appropriate resin capable of bonding the pour spout material to the hinge material and the hinge material to the cartridge material. The pour spout can also be welded to the hinge, and the hinge to the cartridge using high frequency or other means to melt the two surfaces together. Any of these processes can be combined to work in conjunction with each other as is common in the manufacturing of plastic components.

The pour spout 500 has elevated walls forming a channel of decreasing width, which both directs and increases the velocity of wastewater passing out of the cartridge 100 and into the housing exit tube 204 (which, in turn, is connected with a building's plumbing; not shown). As can be seen in FIGS. 17 and 18, desirable dimensions for the pour spout 500 include a tip width 1802 of approximately 4 mm and an upper portion width 1804 of approximately 20 mm. The pour spout height 1806 is approximately 25 mm and the pour spout depth 1808 is approximately 25 mm with an overall pour spout radius 1810 of approximately 50 mm. Thus, the angled and curved cartridge exit 104 and the pour spout 500 reduce splashing and increase velocity, both factors in the present invention's effectiveness in reducing struvite.

Figure 19B:
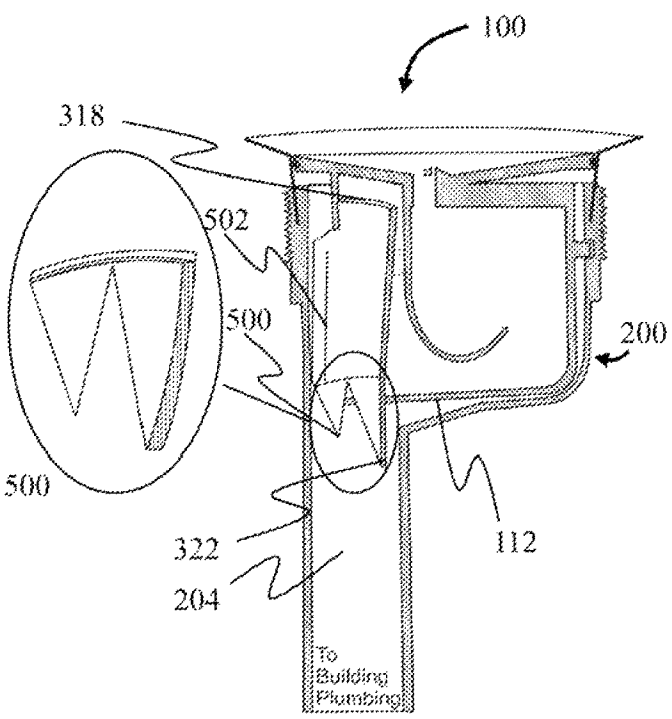
FIGS. 19A and 19B are illustrations of a blown-up side cutaway view of an anti-splash exit capable of use with both side exit and down exit prior art housings, according to the present invention.
Figure 19A:
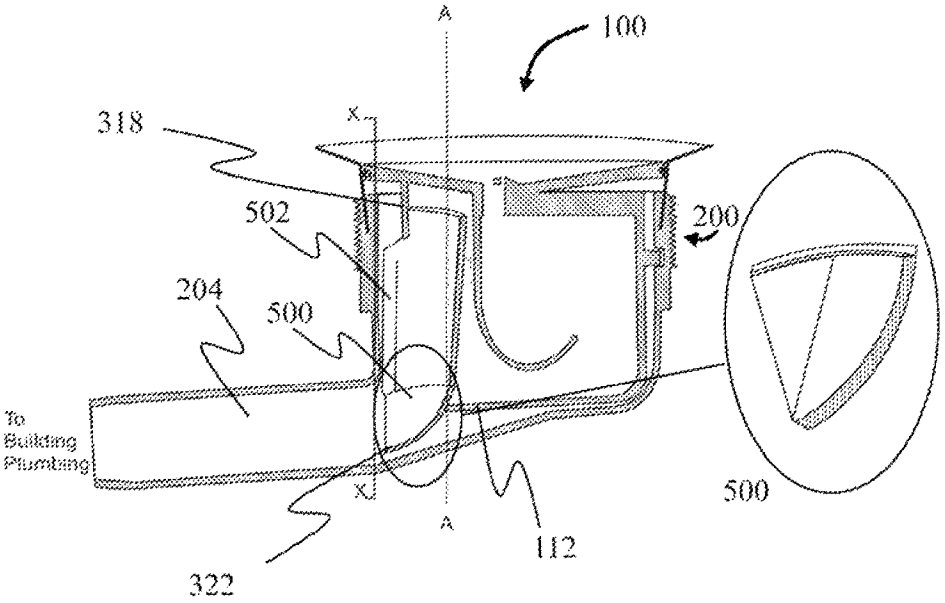

The cartridge 100 and the housing 200 combinations are shown in FIG. 19A and FIG. 19B, where FIG. 19A shows the cartridge 100 inserted into the housing 200 having a horizontal exit tube 204 and FIG. 19B shows the same cartridge inserted into a housing 200 having a vertical exit tube 204. In this case, the design of the pouring spout 500 is made to accommodate either arrangement. The pour spout 500 is made such that when placed in a cartridge 100 with a horizontal exit tube 204, the portion of the poring spout 500 that forms the exit drip edge 322 remains closed so that it directs wastewater in a substantially horizontal direction into the housing exit tube 204. On the other hand, when placed into a housing 200 having a vertical housing exit tube 204 as shown in FIG. 19B, the pouring spout 500 splits open and allows wastewater to enter the housing exit tube 204 in a substantially vertical direction. The same manufacturing methods previously discussed may be used to form this version of the pouring spout 500 and the pouring spout may be attached directly to the cartridge 100 or may be hinged from the cartridge 100.

Figure 20:
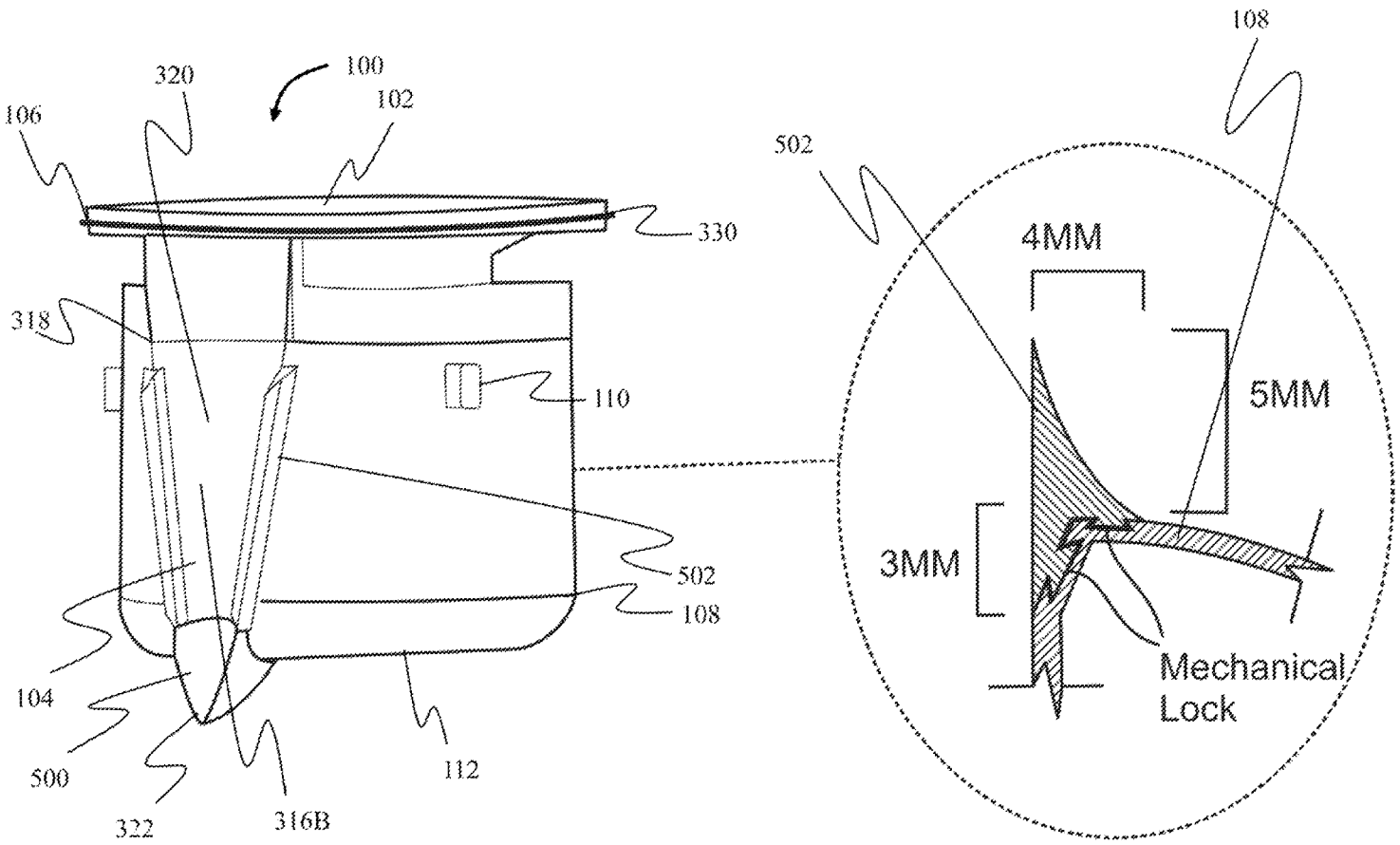
FIG. 20 is an illustration of a blown-up cross section of an anti-splash wiper which runs from the top of the spout or just above the base of the bottom of the cartridge to just below the overflow, according to the present invention.

A blown-up cross section of a wiper 502 is shown in FIG. 20. The wipers run from the top of the pouring spout 500 (or just above the bottom wall 112 of the cartridge 100) to just below the overflow level 318. The wipers 502 cover the distance from the cartridge side wall 108 to the inside of the side of the housing body 200 (as can be seen in FIG. 14). The wipers 502 can be slightly oversized so that they can deform against the inside of the housing body 200 which helps to form a seal therebetween (though they can also be effective even if they don't touch the side wall of the housing 200). On a cartridge 100 such as model C1M2+ by Falcon Waterfree Technologies, LLC, this distance is approximately 4 mm. The wipers 502 with a depth of 5 mm can contact the side wall of the housing 200. As shown, the wipers 502 are thicker at the base where they connect to the cartridge to provide more bonding surface area, and then taper to a thin wiping edge, similar to a windshield wiper. This allows them to easily deform when they meet the side of the housing. The respective dimensions are approximately 4 millimeters wide at the base where they connect to the cartridge and about 0.5 millimeters at the top where they touch the side wall of the housing. A portion of FIG. 20 on the right, shows an example of a locking mechanism.

Figure 21:
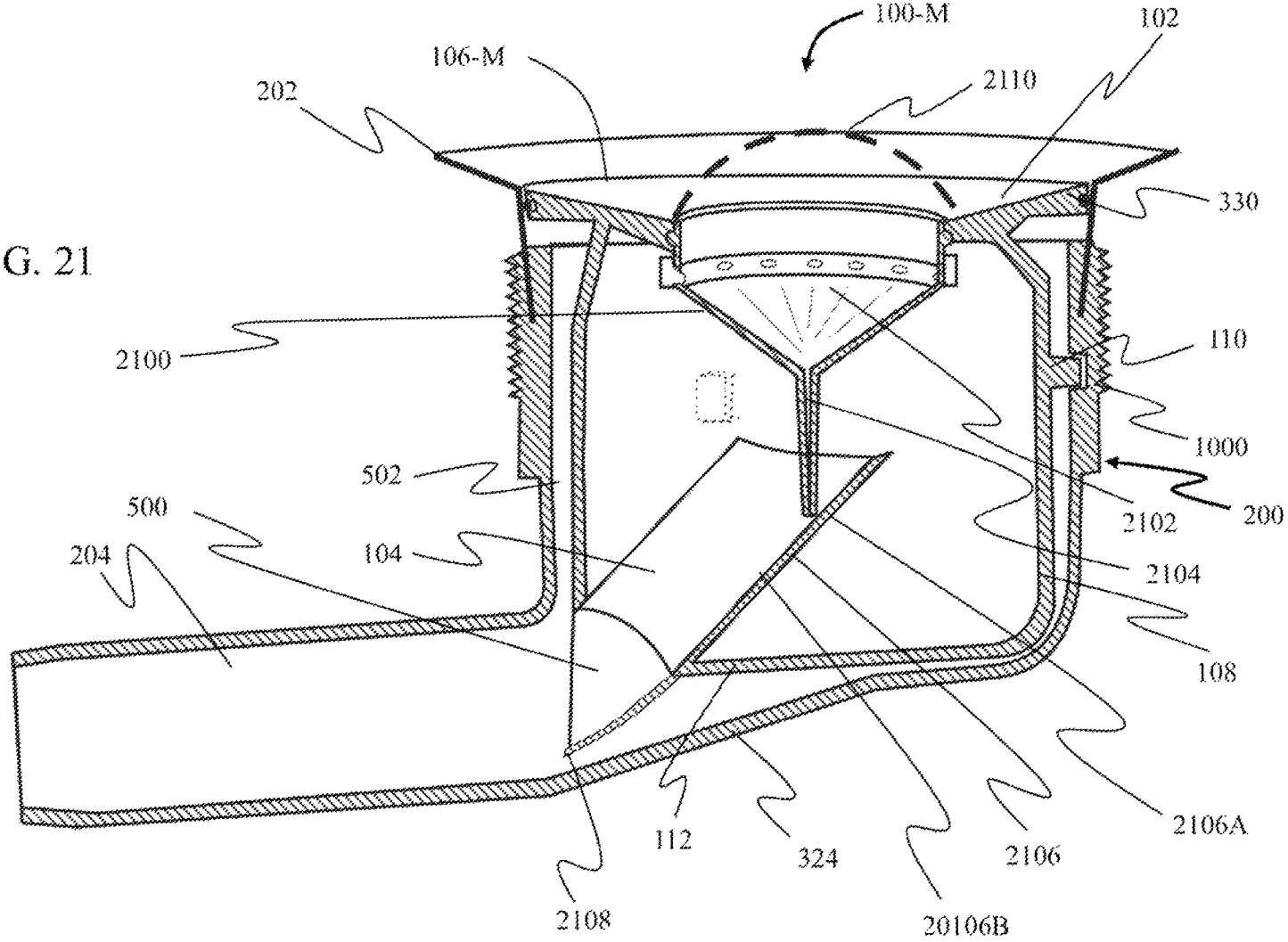
FIG. 21 is an illustration of a cutaway side view of a mechanical trap version of the present invention incorporating a splash reducing exit, where an exit back wall is tiled away from the vertical axis and the exit is "U"-shaped so that fluid will centralize on the exit back wall, according to the present invention.

A version of the present invention that includes a mechanical trap 2100 is shown in FIG. 21. The body of the cartridge 100 is similar to that of a liquid trap cartridge. This cartridge 100 holds a mechanical trap 2100, which has a collection area 2102 that centralizes the effluent as it enters the mechanical trap 2100. The mechanical trap has a seal point 2104 that stays closed unless the weight of a liquid is upon it; at which point it is forced open, allowing the liquid to run through it. In this cartridge 100, the exit back wall 2106 is angled away from the vertical axis and the cartridge exit 104 is U-shaped so that fluid will centralize on the exit back wall 2106 (the fluid back wall 2106 of a mechanical trap 2100 cartridge 100 is analogous to the outlet compartment vertical separator 316 of the liquid trap cartridges previously discussed). The pour spout 2108 is similar in shape and design to the pour spouts 100 previously discussed with respect to the liquid trap configurations. Thus, the pour spout 2108 directs outflowing fluids in a substantially horizontal direction as they pass down the exit back wall 2106 and through the pour spout 2108 and into the housing exit tube 204. This virtually eliminates the splash normally experienced in the prior art configurations with mechanical traps, which dump effluent in the center of the housing and create significant struvite buildup. Note that a debris screen 2110 is shown. The debris screen 2110 prevents debris from entering and clogging the mechanical trap 2100.

The pour spout 2108 of the mechanical trap cartridge 100 can be manufactured with all of the techniques and variations previously discussed with regard to fluid trap versions and can be similarly adapted for use with housing bodies 200 that have horizontal housing exit tubes 204 and vertical housing exit tubes 204. Thus, the pour spout 2008 can be formed to sit below the level of the housing bottom 326 in the housing trough 324 (in some cases, in fluid communication with the housing trough 324) while being flexible to permit a twist-to-lock configuration.

With the combination of a pour spout 500 that can flex, hanging below the cartridge 100 and into the housing trough 324, a tapered shape to the cartridge exit 104 (when measured from top of the overflow level 318 to the pour spout 500), a generally U-shaped cartridge exit 104, and a generally U-shaped area proximate the overflow level 318, higher velocity with a narrowed, focused, aimed, stream can be created where previously liquid was allowed to simply flow substantially vertically and splash into the bottom of the housing and trough area. A similar exit configuration can be used for both fluid barrier and mechanical trap-type cartridges 100. This is a meaningful advantage over the prior art, as the splash is a major cause of struvite precipitation and buildup. Further, the narrowed and focused fluid stream afforded by the present invention can also help to clear out any struvite buildup that has occurred, as it serves to "power wash" the area to where it is directed. As mechanical traps are often flushed with water, this cleaning action can be a very large advantage not only during regular use, but also during water flushes.

Figure 22B:
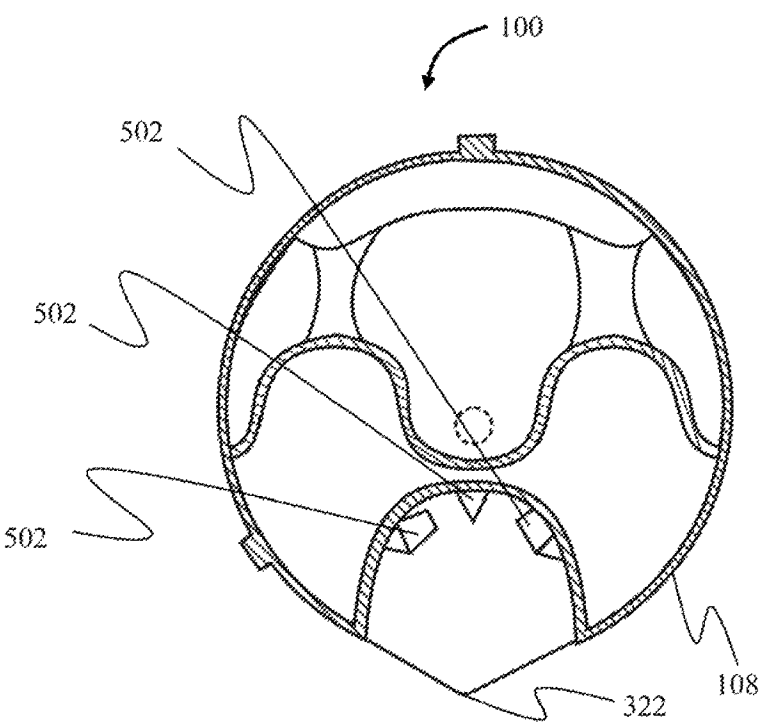
FIGS. 22A and 22B are illustrations of a cartridge shown in a side view in FIG. 22A and a top cross-sectional view in FIG. 22B, where multiple wipers are provided on the cartridge wall and converge toward the exit drip edge of the cartridge to direct urine flow, according to the present invention.
Figure 22A:
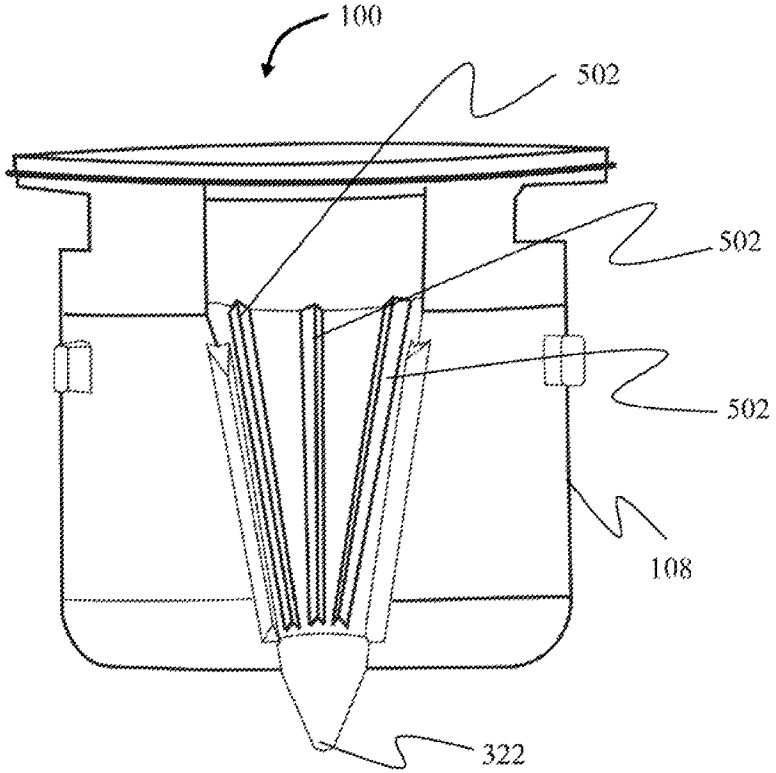

A further example of a cartridge 100 according to the present invention is shown in a side view in FIG. 22A and a top cross-sectional view in FIG. 22B. In this case, multiple wipers 502 are provided on the cartridge wall 108. Here, the wipers 502 converge toward the exit drip edge 322 of the cartridge 100 to direct urine flow therethrough.

ELEMENTS LIST

The following list of elements is provided for ease of reference.

100—Cartridge
102—Cartridge Inlet
104—Cartridge Exit
106—Top Wall Flange
108—Cartridge Side Wall
110—Locking Tine
112—Bottom Wall
200—Housing Body
202—Housing Flange
204—Housing Exit Tube
300—Fluid Barrier Layer
302—Fluid Level
304—Inlet Compartment
306—Cartridge Ceiling
308—Outlet Compartment
310—Baffle
312—Vertical Separator
314—Sealant Layer
316—Outlet Compartment Vertical Separator
316A—Outlet Compartment Vertical Separator (back of wall first side)
316B—Outlet Compartment Vertical Separator (front of wall, second side)
318—Overflow Level
320—Discharge Section
322—Exit Drip Edge
324—Housing Trough
326—Housing Bottom
330—O-Ring
500—Pour Spout
502—Wiper
800—Vent
802—Throat
804—Overflow Gap
1000—Locking Tine Keyway
1800—Hinge Area
2100—Mechanical Trap
2102—Tapered Collection Area
2104—Seal Point
2106—Exit Back Wall
2110—Debris Screen
2108—Drip Edge

What is claimed is:

1. A splash-reducing urinal cartridge having a fluid exit portion, the exit portion of the urinal cartridge comprising:

a splash reducer having a narrowed fluid flow path for causing the fluid to exit the cartridge in a substantially horizontal direction and in a narrowed and focused manner, wherein the splash reducer is formed to increase velocity of the fluid while reducing splashing as the fluid exits.

2. A splash-reducing urinal cartridge as set forth in claim 1, wherein the splash reducer is a spout.

3. A splash-reducing urinal cartridge as set forth in claim 2, wherein the spout further comprises a tapered exit area.

4. A splash-reducing urinal cartridge as set forth in claim 2, wherein the spout further comprises converging fins that assist in urging fluid to collect in a progressively narrower channel.

5. A splash-reducing urinal cartridge having a splash reducer as set forth in claim 1, wherein the splash reducer is configured such that when the cartridge is installed in a urinal, the splash reducer urges fluid exiting the cartridge to flow in a direction selected from a group consisting of substantially parallel to an exit of the cartridge housing into which the cartridge is installed and proximate the splash reducer; and substantially parallel to building plumbing proximate the splash reducer; whereby the fluid exits the cartridge in a splash-reduced manner.

6. A fluid exit portion for a splash-reducing urinal cartridge as set forth in claim 1, wherein the splash reducer is adjustable in a manner selected from a group consisting of being formed of a flexible material and being hinged with respect to a portion of the cartridge; thereby causing the cartridge to be easier to install.

7. A splash-reducing urinal cartridge as set forth in claim 1, where the splash reducer further compromises a fluid flow surface for receiving flowing fluid and where the fluid flow surface is coated with a hydrophobic coating.

8. A fluid exit portion for a splash-reducing urinal cartridge as set forth in claim 1, where the splash reducer further comprises a fluid flow surface for receiving flowing fluid and where the fluid exit portion further comprises an exit wall for delivering fluid from the cartridge to the splash reducer such that fluid flowing from the exit wall encounters the splash reducer in a direction substantially parallel to the fluid flow surface at a location where the flowing fluid encounters the fluid flow surface; whereby when fluid flows through the exit portion, the fluid handoff between the exit wall and the splash reducer in a splash-reduced manner.

9. A splash reducing urinal cartridge as set forth in claim 1 where the splash reducer is progressively tapered.

10. A splash reducing urinal cartridge as set forth in claim 1, where the splash reducer is configured to direct the fluid exiting therefrom toward a desired target.

11. The splash-reducing urinal cartridge as set forth in claim 1, wherein the splash reducer is positioned external to the cartridge.

12. The splash-reducing urinal cartridge as set forth in claim 1, wherein the splash reducer is configured to create a seal with the housing trough, leaving no distance for splashing to occur between the splash reducer and the housing trough.

13. A splash-reducing urinal cartridge having a fluid exit portion, the exit portion of the urinal cartridge comprising:

a malleable splash reducer compliant with regard to an interior of a cartridge housing, wherein the malleable splash reducer is formed such that when the cartridge is rotatably inserted into the cartridge housing, the malleable splash reducer changes its configuration to align with a housing trough of the cartridge housing to minimize splashing of urine between the splash reducer and the housing.

14. The splash-reducing urinal cartridge as set forth in claim 13, wherein the malleable splash reducer resides within the housing trough when the cartridge is inserted into the cartridge housing.

15. A splash-reducing urinal cartridge having a fluid exit portion, the exit portion of the urinal cartridge comprising:

a pour spout having a narrowed fluid flow path for causing the fluid to exit the urinal cartridge in a narrowed manner, wherein the pour spout is configured such that when the urinal cartridge is in a final position within a cartridge housing, the pour spout is aligned with a urinal cartridge housing exit.

16. The splash-reducing urinal cartridge as set forth in claim 1, wherein the splash reducer is malleable.

17. The splash-reducing urinal cartridge as set forth in claim 1, further comprising a top wall, a bottom wall, and a side wall between the top wall and the bottom wall, wherein the splash reducer hangs below the bottom wall.

* * * * *